US009338851B2

(12) United States Patent
Melanson et al.

(10) Patent No.: US 9,338,851 B2
(45) Date of Patent: May 10, 2016

(54) OPERATION OF A LED LIGHTING SYSTEM AT A TARGET OUTPUT COLOR USING A COLOR SENSOR

(71) Applicant: INSTITUT NATIONAL D'OPTIQUE, Quebec (CA)

(72) Inventors: Stephane Melanson, Shediac Cape (CA); Marco Michele Sisto, Quebec (CA)

(73) Assignee: INSTITUT NATIONAL D'OPTIQUE, Quebec, Quebec (CA)

( * ) Notice: Subject to any disclaimer, the term of this patent is extended or adjusted under 35 U.S.C. 154(b) by 0 days.

(21) Appl. No.: 14/250,084

(22) Filed: Apr. 10, 2014

(65) Prior Publication Data

US 2015/0296589 A1 Oct. 15, 2015

(51) Int. Cl.
*H05B 33/08* (2006.01)

(52) U.S. Cl.
CPC ..... *H05B 33/0869* (2013.01); *H05B 33/086* (2013.01); *H05B 33/0821* (2013.01); *H05B 33/0827* (2013.01); *H05B 33/0866* (2013.01); *H05B 33/0872* (2013.01)

(58) Field of Classification Search
CPC ..... H05B 33/0866; H05B 33/086; H05B 33/0863; H05B 33/0869; H05B 33/0803; H05B 33/0818; H05B 33/0821; H05B 33/0827; H05B 33/0872; H05B 33/089; G01J 3/51; G01J 3/513; G01J 2001/4252; Y10S 362/80; G09G 3/3406; G09G 3/3413; G09G 3/3426; G09G 2320/0242; G09G 2320/0666; G09G 2360/147; G09G 2320/064; Y02B 20/341; Y02B 20/346; B61L 5/1881; H04N 1/6086
See application file for complete search history.

(56) References Cited

U.S. PATENT DOCUMENTS

| | | | | |
|---|---|---|---|---|
| 6,411,046 | B1 * | 6/2002 | Muthu | 315/309 |
| 6,448,550 | B1 | 9/2002 | Nishimura | |
| 6,507,159 | B2 | 1/2003 | Muthu | |
| 6,552,495 | B1 | 4/2003 | Chang | |
| 6,576,881 | B2 * | 6/2003 | Muthu et al. | 250/205 |
| 6,600,562 | B1 * | 7/2003 | Chang | 356/405 |
| 6,630,801 | B2 | 10/2003 | Schuurmans | |
| 7,009,343 | B2 | 3/2006 | Lim et al. | |
| 7,230,222 | B2 * | 6/2007 | Cheng | H05B 33/0821 250/205 |
| 7,256,557 | B2 | 8/2007 | Lim et al. | |
| 7,315,139 | B1 | 1/2008 | Selvan et al. | |
| 7,319,298 | B2 | 1/2008 | Jungwirth et al. | |

(Continued)

OTHER PUBLICATIONS

Deurenberg et al., "Achieving color point stability in RGB multi-chip LED modules using various color control loops", Proc. of SPIE vol. 5941, 2005, 59410C pp. 1-12.

(Continued)

*Primary Examiner* — Vibol Tan
(74) *Attorney, Agent, or Firm* — Merchant & Gould P.C.

(57) ABSTRACT

A method for operating a LED lighting system at a target output color is provided. The LED system includes a color sensor and three or more LED emitters each operable at a controllable emitter drive setting. The method provides at least one calibration matrix defining a relationship between measurements obtained from the color sensor, represented by sensor color point coordinates, and absolute color point coordinates in an absolute color space. In some embodiments, a calibration matrix defining a non-linear relationship between the two color spaces is provided. In other embodiments, individual calibration matrices are provided for each LED emitter.

34 Claims, 13 Drawing Sheets

(56) References Cited

U.S. PATENT DOCUMENTS

| | | | | |
|---|---|---|---|---|
| 7,397,205 | B2 | 7/2008 | Huang et al. | |
| 7,547,869 | B2 * | 6/2009 | Helbing | G01J 1/32 250/205 |
| 7,573,210 | B2 | 8/2009 | Ashdown et al. | |
| 7,718,942 | B2 | 5/2010 | Lim et al. | |
| 7,868,562 | B2 | 1/2011 | Salsbury et al. | |
| 8,013,533 | B2 | 9/2011 | De Rijck et al. | |
| 8,110,995 | B2 | 2/2012 | Deurenberg | |
| 8,159,150 | B2 | 4/2012 | Ashdown et al. | |
| 8,193,737 | B2 | 6/2012 | Peker et al. | |
| 8,278,847 | B2 * | 10/2012 | Chen et al. | 315/312 |
| 8,525,444 | B2 * | 9/2013 | Van Duijneveldt | H04N 1/6086 315/308 |
| 9,013,467 | B2 * | 4/2015 | Sisto | 345/212 |
| 9,018,853 | B2 * | 4/2015 | Johannessen et al. | 315/291 |
| 2011/0109232 | A1 | 5/2011 | Schulz et al. | |
| 2013/0038241 | A1 * | 2/2013 | Johannessen et al. | 315/294 |

OTHER PUBLICATIONS

Hung, "Colorimetric Calibration for Scanners and Media", SPIE vol. 1448 Camera and Input Scanner Systems, 1991, pp. 164-174.

Lim et al., "Illumination and Color Management in Solid State Lighting", IEEE, vol. 5, 2006, pp. 2616-2620.

Hailer, "Optimization of Absolute Accuracy for True Color Sensors in a Closed Control Loop", LED Professional Symphosium + Expo, LPS 2012, Session IV, True Color Sensors, pp. 1-5.

Nimz et al., "Sensors and Feedback Control of Multi-Color LED Systems" LED Professional, LPR Nov./Dec. 2012, Issue 34, pp. 1-5.

Muthu et al., "Red, Green, and Blue LEDs for White Light Illumination", IEEE Journal on Selected Topics in Quantum Electronics, vol. 8, No. 2, Mar./Apr. 2002, pp. 333-338.

Muthu et al., "Red, Green and Blue LED-based White Light Source: Implementation Challenges and Control Design", SPIE, vol. 1, 2003, pp. 515-522.

* cited by examiner

OPERATION OF A LED LIGHTING SYSTEM AT A TARGET OUTPUT COLOR USING A COLOR SENSOR

FIELD OF THE INVENTION

The present invention relates to LED lighting systems, and more particularly concerns a color control method for multi-chromatic LED lighting systems using a color sensor.

BACKGROUND

Light-emitting diodes (LED) lighting systems, emitting either white light or colored light, are used for numerous applications such as interior and exterior lighting, decorative lighting, entertainment and the like. LED lighting systems are typically composed of a plurality of individual LED emitters each having a different narrow spectral bandwidth. The light output of the overall system is a colorimetric combination of the light generated by the individual emitters.

The use of LED-based systems for lighting applications provides several advantages. A major advantage is the superior power conversion efficiency of LED emitters, which can reach close to 200 lumens per watt—by comparison, a typical incandescent lamp outputs only around 17 lumens per watt while a fluorescent lamp provides around 80 lumens per watt. Other advantages of LED emitters include their long lifetime, achieving around 100 000 hours of lighting, and the ability to precisely control the color of the output light. All these advantages make LED lighting systems very attractive lighting solutions.

There are, however, a few difficulties related to LED-based lighting. Firstly, the spectrum of individual LED emitters tends to shift over time, resulting in an ageing-related drift of the output color. This shift of the output color evolves in a complex manner and cannot be predicted by theoretical models. Secondly, the output color can vary as a function of operation conditions such as the temperature of the LED lighting system or the currents that drive one or more of the LED emitters.

The quality of the light generated by a LED lighting system affects the perceived colors of an illuminated scene: the color rendering property of a LED system is therefore a factor to be taken into account. Color rendering can be characterized using the CRI (Color Rendering Index), which is a color rendering metric standardized by the CIE (Commission Internationale de l'Éclairage), or the CQS (Color Quality Scale), which is an alternative metric proposed by the NIST (National Institute of Standards and Technology). For example, it is recognized in the literature that a CRI of at least 90 is desirable for lighting applications.

Color rendering metrics are particularly meaningful for LED lighting systems that generate white light. A minimum of three primary colors are required for additive color synthesis of white light, typically red, green and blue (RGB). Typical LED lighting systems with only three LED emitters cannot easily provide white light with good color rendering properties. LED-based lighting systems having four or more LED emitters with different "primary" colors can be used to reach or to exceed the CRI threshold of 90, if appropriately controlled. At least four LED emitters are therefore preferred for quality lighting applications, such as in museums and for advertisement purposes. However, to obtain the desired results the LED light system must be carefully controlled to achieve a constant color output for all values of operation temperature and drive current, for the lifetime of the LED lighting system.

It is known in the art to use color feedback during operation of a LED lighting system in order to compensate for drifts of the output color. A color detector is used to "read" the color of the output light of the LED system and a correction of the operating conditions can be applied to compensate for any shift that arises, based on the information obtained. The main difficulty associated with implementing a color feedback scheme is the measurement of the color of the LED emitters. The CIE introduced three functions to represent the three color receptors in an average human eye. The color of the light emitted from a lighting system can be represented by three quantities (X, Y, Z) that represent the integration of a measured spectrum of the light over these functions. A direct manner of obtaining the color of a light source is therefore to measure the spectrum of its emitted light and then integrate over the CIE functions to obtain the three quantities. However, measuring the spectrum of a lighting system requires the use of expensive equipment such as a spectrometer. An alternative is to use a color sensor or colorimeter. Such sensors are typically composed of three filtered detectors and are much more affordable than spectrometers. The filters can be selected to match the three colorimetric functions of the CIE, in which the sensor output corresponds to the CIE color coordinates X, Y and Z of the detected light. In practice, it is however very difficult to obtain filters that correspond exactly to the colorimetric functions. Therefore, the values outputted by color sensors do not really correspond to the (X,Y,Z) quantities characterizing the color of the output light.

There therefore remains a need for a control method for a LED lighting system that alleviates at least some of the drawbacks above.

SUMMARY

In accordance with one aspect of the invention, there is provided a method for operating a LED lighting system at a target output color. The LED system has three or more LED emitters emitting light of different colors combined into a light output, each LED emitter being operable at a controllable emitter drive setting. The LED lighting system further includes a color sensor.

The method includes the steps of:

a) providing calibration data which includes values for the light output of the LED lighting system for a plurality of values of the emitter drive settings of the emitters. At least one calibration matrix defining a relationship between measurements obtained from the color sensor of the LED lighting system and represented by sensor color point coordinates, and absolute color point coordinates in an absolute color space is also provided;

b) operating the LED emitters at emitter drive settings selected in view of the target output color and based on the calibration data;

c) measuring the sensor color point coordinates of the light output using the color sensor;

d) determining the absolute color point coordinates of the light output based on the sensor color point coordinates measured at step c) and the at least one calibration matrix;

e) comparing the absolute color point coordinates determined at step d) to target color point coordinates representing the target color to determine if a predetermined matching condition is met. If not, repeating steps c) to e) using different operation drive settings.

Preferably, the LED lighting system has a same optical configuration during operation as during a calibration process having provided the at least one calibration matrix.

In some embodiments, the calibration matrix or matrices relate non-linear functions of the sensor color point coordinates to the absolute color point coordinates. The calibration matrices may also include a plurality of emitter calibration matrices each associated with an individual one of the LED emitters.

In accordance with another aspect, there is provided a LED lighting system for operation at a target output color.

The LED lighting system first includes three or more LED emitters emitting light of different colors combined into a light output, and a LED driver electrically connected to each LED emitter. Each LED driver is configured to apply a controllable emitter drive setting to the corresponding LED emitter.

The LED lighting system further includes a color sensor positioned for measuring a portion of said light output.

A memory is further provided, containing calibration data. The calibration data has been obtained from measuring the light output of the LED lighting system for a plurality of values of the emitter drive settings. The memory further contains at least one calibration matrix defining a relationship between measurements from the color sensor of the LED lighting system represented by sensor color point coordinates and absolute color point coordinates in an absolute color space.

The LED lighting system further includes a controller, configured to:

a) control the LED drivers to operate the LED emitters at emitter drive settings selected in view of the target output color;

b) measure the sensor color point coordinates of the light output using the color sensor;

c) determine the absolute color point coordinates of the light output based on the sensor color point coordinates measured at step c) and the at least one calibration matrix; and d) compare the absolute color point coordinates determined at step c) to the target color point coordinates representing said target color to determine if a predetermined matching condition is met, and, if not, and repeat steps b) to d) using different operation drive settings.

Other features and advantages of the invention will be better understood upon reading of preferred embodiments thereof with reference to the appended drawings.

DETAILED DESCRIPTION OF EMBODIMENTS

Figure 1:
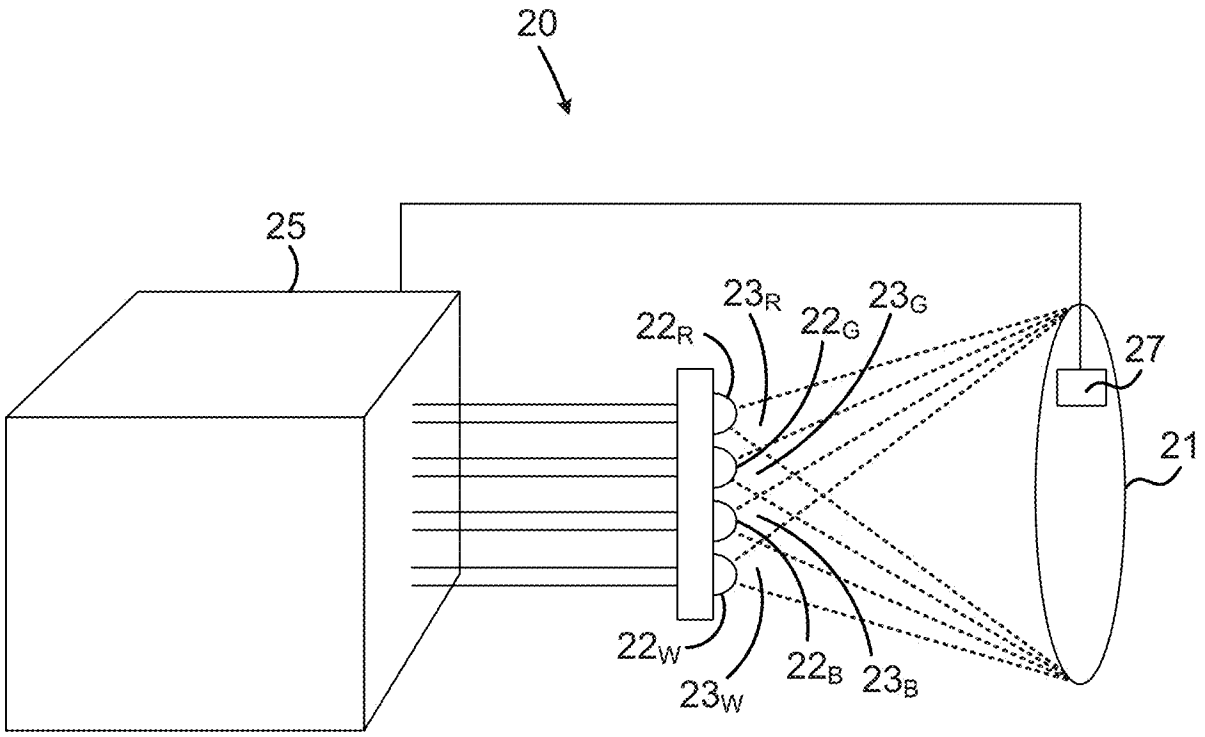
FIG. 1 is a perspective view of a multi-chromatic LED lighting system that can be controlled in accordance with embodiments of the invention.

In the following description, similar features in the drawings have been given similar reference numerals and in order to avoid weighing down the figures, some elements may not be referred to on some figures if they were already identified in preceding figures. It should also be understood herein that the elements of the drawings are not necessarily drawn to scale and that the emphasis is instead being placed upon clearly illustrating the elements and structures of the present embodiments.

The present invention generally relates to the control of multi-chromatic LED (Light-Emitting Diode) lighting systems. LED lighting systems may be used for numerous applications such as interior and exterior lighting, decorative lighting, entertainment and the like. Referring to FIG. 1, a LED lighting system 20 is shown by way of example. The LED lighting system 20 may include three, four or more LED emitters 22, each having a different color, controlled by appropriate control electronics 25. In typical three-emitter embodiments, the LED emitters 22 may for example embody a RGB scheme, the LED lighting system therefore including a red emitter $\mathbf{22}_R$, a green emitter $\mathbf{22}_G$ and a blue emitter $\mathbf{22}_B$. In the illustrated example of FIG. 1 a four-emitter embodiment is shown, where the fourth emitter may typically be a white emitter $\mathbf{22}_W$, therefore embodying a RGBW color scheme. Although the description below will mostly be applied to RGB and RGBW embodiments, it will be readily understood that the present invention may be applied to various color schemes or number of LED emitters. For example, some four-emitter LED devices use amber (A) or yellow (Y) emitters instead of white ones, in addition to red (R), green (G) and blue (B) emitters.

As known in the art, the resulting light output 21 generated by a LED lighting system is perceived as a colorimetric combination of the individual light beams $\mathbf{23}_R$, $\mathbf{23}_G$, $\mathbf{23}_B$ and $\mathbf{23}_W$ generated by the different LED emitters of the system. Varying the relative intensities of these light beams therefore provides a control of the resulting overall color.

Although the present description refers to LED systems made up of three or more LED emitters having different colors, one skilled in the art will understand that in practice, a LED system may include a greater number of emitters forming groups of same colored emitters, for example a group of red emitters, a group or green emitters and a group of blue emitters in a RGB scheme. The LED emitters of a same group may be electrically connected together or operated individually. It will be readily understood that in such cases the present method may be applied to one LED emitter of each group and the remaining LED emitters of the same group controlled according to the same parameters, or, alternatively, identical LED emitters may each be controlled according to the principles explained herein without departing from the scope of the present invention.

It will also be understood that referring to "LED emitters of different colors" is a shorthand for indicating that the light beams generated by the respective emitters have different colors.

Detailed Description of the LED Lighting System

Figure 2A:
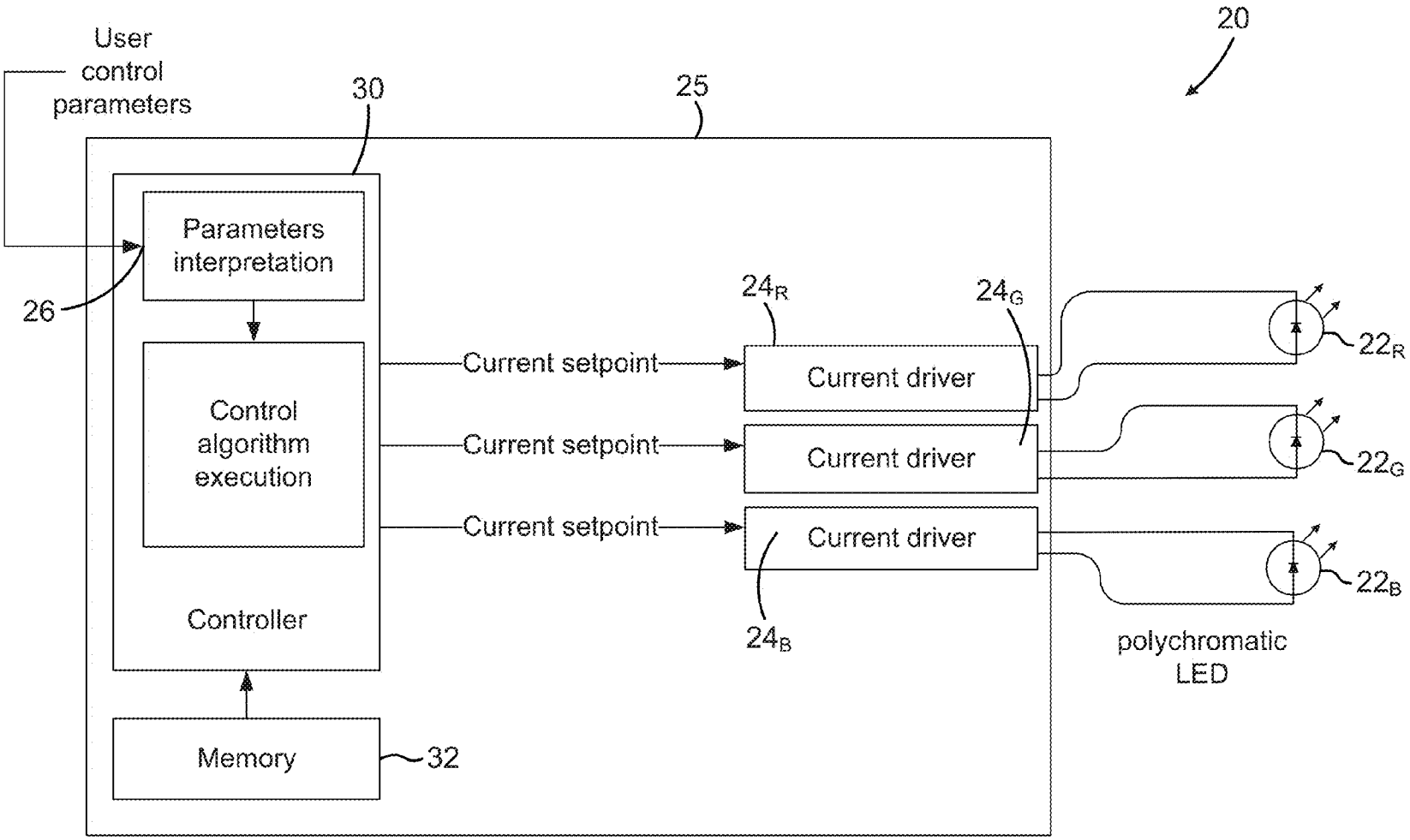
FIG. 2A to 2D are schematic representations of LED lighting systems according to embodiments of the invention, respectively including three (FIG. 2A) and four (FIG. 2B to 2D) LED emitters.
Figure 2B:
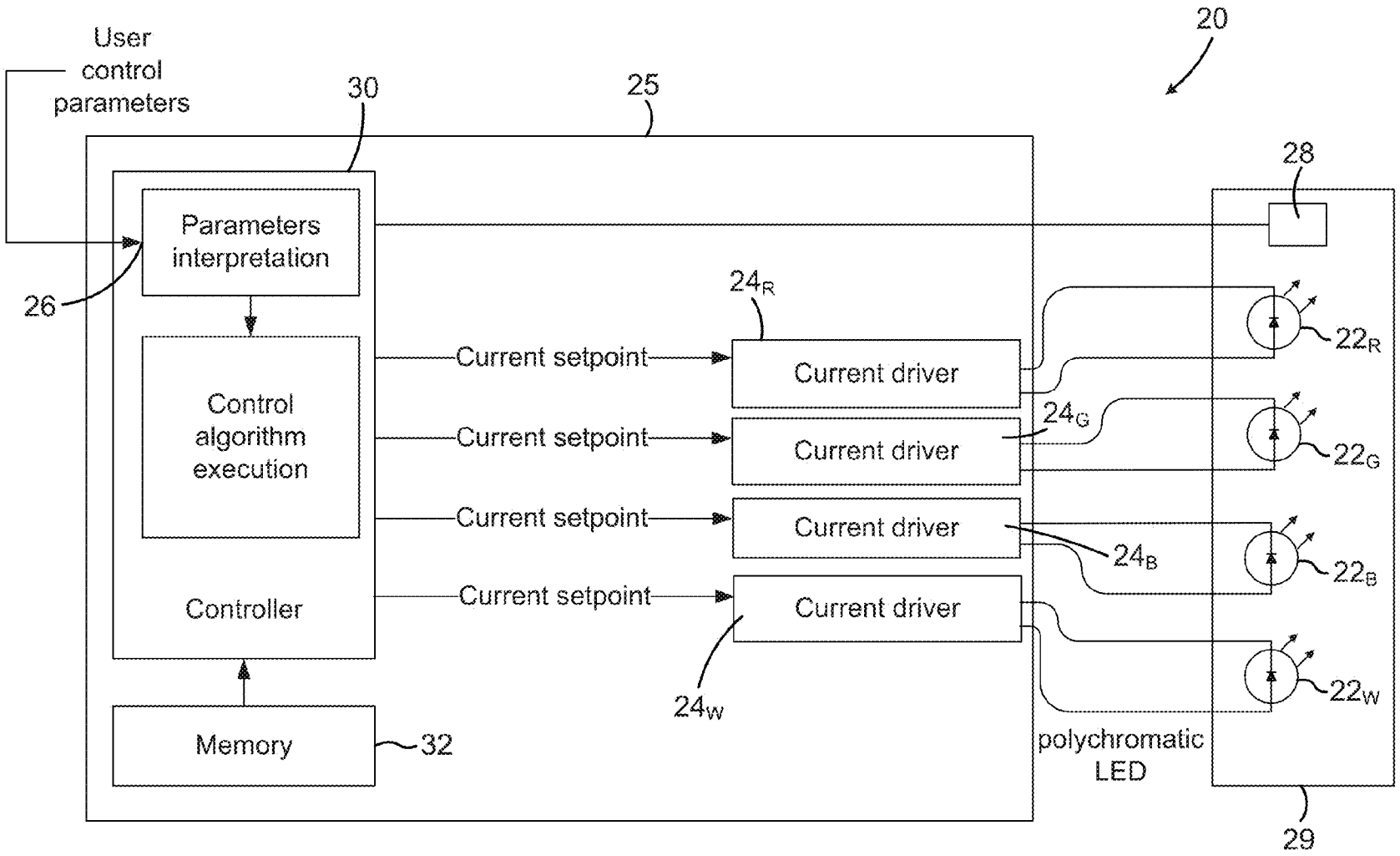

Referring to FIGS. 2A and 2B, the components of exemplary LED lighting systems 20 according to embodiments are schematically illustrated. The system 20 includes three or four LED emitters of different colors, here embodied by a red emitter $\mathbf{22}_R$, a green emitter $\mathbf{22}_G$ a blue emitter $\mathbf{22}_B$ in both embodiments of FIGS. 2A and 2B, and further including a white emitter $\mathbf{22}_W$ in the embodiment of FIG. 2B. A LED emitter is typically embodied by a chip made up of semiconductor materials doped with impurities, forming a p-n junction. An electrical current flows through the junction and it generates light of wavelength determined, among other factors, by the band-gap energy of the materials. Each LED emitter may be embodied by a "regular" or "direct emission" LED, or by a PCLED (phosphor-converted LED).

The LED system is configured for operation at a target output color. The expressions "target output color" or "target color" refer to the color of the light which is to be achieved by the LED lighting system, resulting from the combination of the light beams generated by the individual LED emitters of the LED lighting system. The target color may be described by color point coordinates in a given color space, i.e., by a model providing a specific mathematical representation of colors. Typical color spaces known in the art include the CIE 1931 XYZ and the CIELAB. CIE 1931 XYZ is historically the first attempt to describe colors on the basis of measurements of human color perception and it is the basis for almost all other color spaces. CIE 1931 XYZ is linear in terms of color mixing. This means that a target color can be expressed as linear combinations of E primary colors weighted by appropriate coefficients $C_k$. In matrix form:

$$\begin{bmatrix} X \\ Y \\ Z \end{bmatrix}_{target} = \begin{bmatrix} X_1 & & X_k \\ Y_1 & \dots & Y_k \\ Z_1 & & Z_k \end{bmatrix} \cdot \begin{bmatrix} C_1 \\ \vdots \\ C_k \end{bmatrix}. \tag{1}$$

where X, Y, Z are the tristimulus coordinates of the target color while $X_k$, $Y_k$ and $Z_k$ are the tristimulus coordinates of each individual LED emitter k. The CIELAB is not linear in terms of color mixing but it is more linear than the CIE 1931 XYZ in terms of color perception. Perceptual linearity means that a change of the same amount in the CIELAB coordinates produces a change of about the same visual importance in the colors represented by those coordinates. Direct and inverse transformation rules exist among common color spaces, so that any given color can be expressed univocally in any chosen color space.

Both CIE 1931 XYZ and CIELAB color spaces can be described as "absolute" color spaces in which colors are unambiguous, that is, the coordinates of a given color in the space are defined with respect to standard parameters without reference to external factors. The coordinates of any color in an absolute color space can, by extension, be referred to as "absolute" color point coordinates. Other examples of absolute color spaces include sRGB, Adobe RGB, CIELUV, and CIE RGB.

Optionally, such as in the illustrated embodiments of FIGS. 2A and 2B, the lighting system 20 includes a user input 26 through which control parameters can be provided by the user. Preferably, the user control parameters may include the target color, which may be in the form of color point coordinates in a given color space or other information allowing deduction of the specific target color required by the user. The user control parameters may be provided through knobs, a keyboard, a mouse, a touchscreen, or any other device providing a suitable user interface. It will however be understood that in other variants the target color may be preprogrammed, selected or deduced automatically without involving the intervention of a user.

Other user control parameters may optionally include luminance, Correlated Color Temperature (CCT), dominant wavelength, saturation, hue, etc.

The lighting system 20 further includes a LED driver 24 electrically connected to each LED emitter 22. The illustrated embodiment of FIG. 2A therefore includes three LED drivers $\mathbf{24}_R$, $\mathbf{24}_G$, $\mathbf{24}_B$ while the embodiment of FIG. 2B further includes a fourth LED driver $\mathbf{24}_W$. The LED drivers 24 may be embodied by any device or combination of devices that can be configured to apply a controllable drive setting to the corresponding LED emitter. It will be readily understood that the intensity of the light generated by a LED emitter can be changed through a control of its driving conditions. Controlling the drive conditions of LED emitters is typically achieved by acting on the time-averaged forward current injected in the LED emitter.

In some embodiments the LED emitters 22 are controlled according to a PWM (Pulse Width Modulation) scheme. In this case the drive setting may be a current modulation duty cycle, that is, the duty cycle of a periodic current waveform having constant predetermined maximum and minimum current values, the minimum current value being possibly an absence of current, i.e., a zero current value. Variants of PWM are known in the literature and may use a fixed or variable modulation frequency, constant or variable current values and complex waveforms. In PMW embodiments, each LED driver 24 includes for example a modulated current source with controllable duty cycle.

In other embodiments the LED emitters may be driven according to a Constant Current (CC) regulation method where the drive setting would be embodied by a constant current value. In CC regulation embodiments, each LED driver 24 includes for example a continuous current source with controllable current amplitude.

Other driving methods, such as pulse frequency modulation, pulse density modulation or the like are also known in the art and considered to be within the scope of the present description.

The lighting system 20 may include a temperature determining module configured to measure, calculate or estimate the operation temperature of the LED lighting system 20. The operation temperature can be representative of temperature values measured at various locations in the system. The temperature determining module may include a device or devices, such as a thermocouple, a thermistor or other appropriate sensor for measuring the temperature at one or more locations in the systems. For example, in the embodiment shown in FIG. 2B the LED emitters $\mathbf{22}_R$, $\mathbf{22}_G$, $\mathbf{22}_B$ and $\mathbf{22}_W$ are shown mounted on a heat sink 29, and a temperature sensor 28 is shown also coupled to the heat sink to measure variations in the heat extracted by the heat sink 29. In another variant (not shown), each individual LED emitter may be mounted on a separate heat sink and a temperature sensor provided on each heat sink.

In another embodiment the temperature determining module may include a junction voltage meter (not shown) connected to each LED emitter in order to measure the corresponding junction voltage drop. The junction voltage drop may be used to determine the junction temperature of each LED emitter. As a LED emitter dissipates heat when lit, the junction temperature depends on a number of parameters including the injected current, the junction voltage drop, the environment temperature and the efficiency of dissipation of the heat flowing from the junction to the environment. Since each LED emitter 22 can be operated under different drive conditions, the junction temperature may vary from emitter to emitter within a same LED lighting system 20. The individual junction temperature value of each LED emitter of a LED lighting system can be used to estimate a value for the operation temperature of the whole system.

Still referring to FIGS. 2A and 2B, the lighting system 20 further includes a controller 30. The controller 30 may be embodied by a microcontroller, a processor, an electronic circuit or by any other device or combination of devices providing the processing/computing power required to perform the tasks described below. The controller 30 is configured to execute the steps of the method according to embodiments of the invention, which will be described further below.

The lighting system 20 further includes a memory 32 containing calibration data for each LED emitter. The calibration data may include values for the light output of the LED lighting system for a plurality of values of the drive settings of the emitters, the light output being measured using both the color sensor and a spectrometer, as will also be explained further below. The memory may be embodied by any device or combination of devices apt to store the calibration data, such as a random-access memory (RAM), a programmable or non programmable read-only memory (ROM), a solid-state memory, an universal serial bus (USB) flash drive, a hard-disk drive, a magnetic tape, an optical disk or the like.

Although the controller 30, memory 32 and LED drivers $\mathbf{24}_R$, $\mathbf{24}_G$, $\mathbf{24}_B$ and $\mathbf{24}_W$ are shown in FIGS. 2A and 2B as parts of a same group of control electronics 25, it will be readily understood that these components may be arranged in a variety of configurations without departing from the scope of the invention.

Figure 2C:
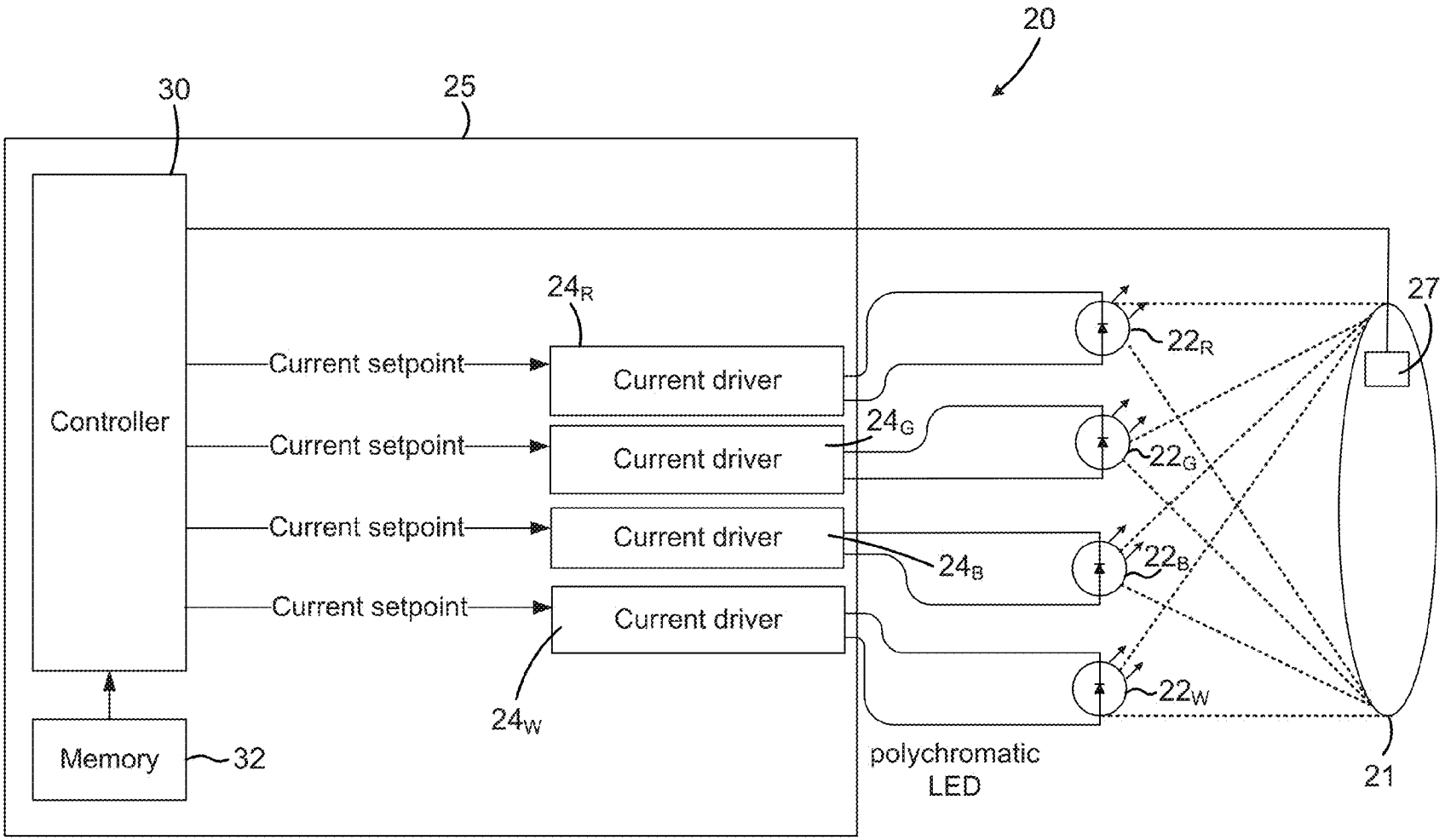
Figure 2D:
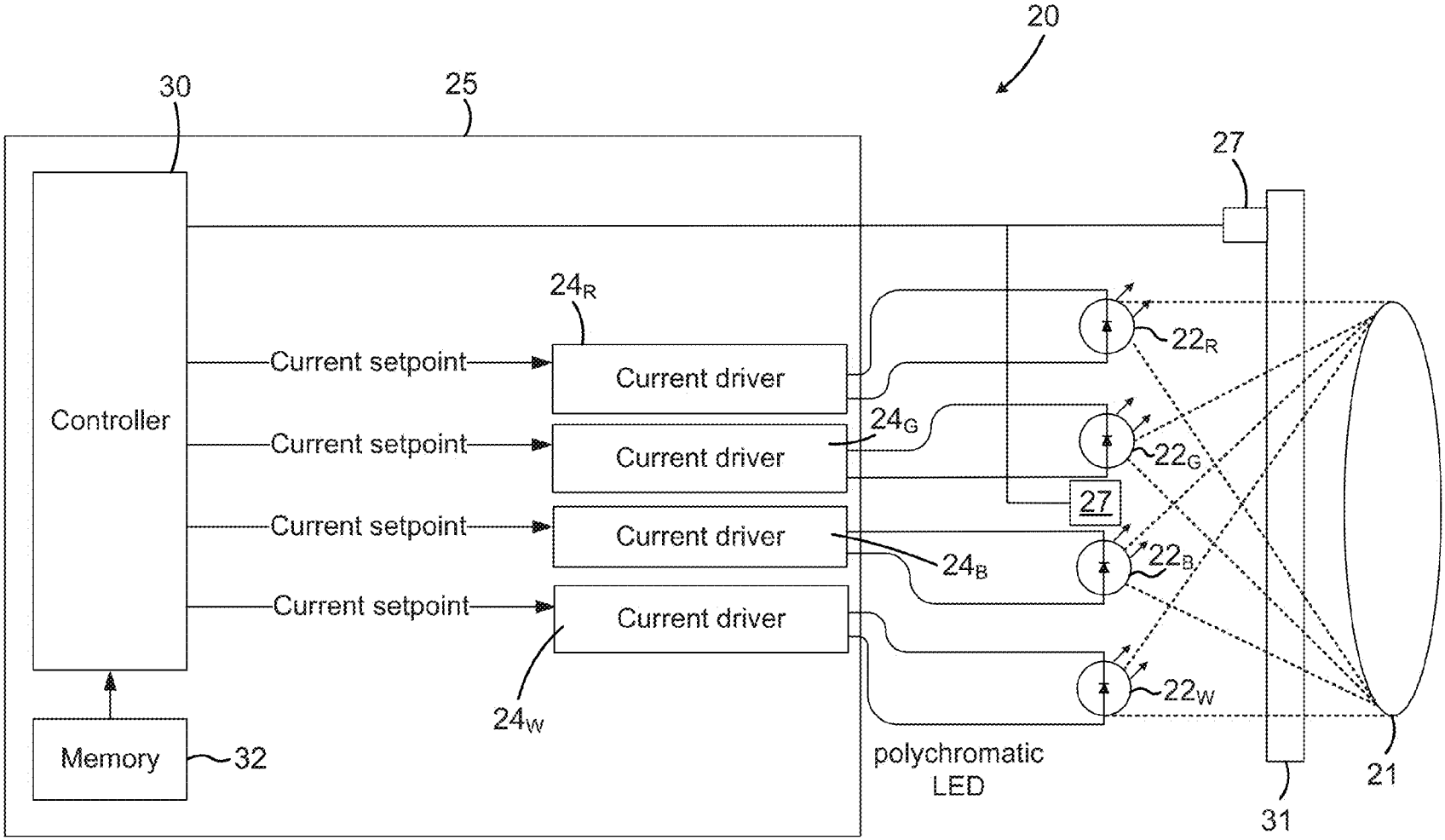

Referring to FIGS. 1, 2C and 2D the LED lighting system 20 further includes a color sensor 27. The expression "color sensor" is understood to refer to a device capable of measuring light intensities included within at least three distinct portions of the visible spectrum, corresponding to three primary colors, such as red (R), green (G), and blue (B). In some embodiments, the color sensor may be based on optically-filtered detection of light to obtain light detection values associated with the different colors. Typically, color sensors include one or more wide-bandpass light detectors, that is, detectors that output a signal amplitude related to the intensity of light incident thereon irrespectively of its wavelength, and a plurality of optical filters disposed in the path of the incoming light before it reaches the light detectors. In this manner, the color sensor 27 can output color-specific values without the need for more complex and expensive spectrometers. It will therefore be readily understood that the color sensor may be embodied by a variety of known devices such as RGB sensors or colorimeters (in which the filters approximately match the CIE 1931 color matching functions). Very low resolution spectrometers, measuring only a few spectral bands in the visible wavelength range, can also be considered as color sensors.

The color sensor is preferably arranged so as to receive a portion of the combined light outputs of the LED emitters for monitoring purposes. For example, FIG. 2C illustrates an embodiment where the color sensor 27 is placed in front of the LED emitters $\mathbf{22}_R$, $\mathbf{22}_G$, $\mathbf{22}_B$ and $\mathbf{22}_W$, within the light output 21 at a great enough distance to collect light that is well mixed. Referring to FIG. 2D, two additional possible configurations are shown. In one such configuration, the sensor 27 may be placed directly beside the LED emitters, so as to collect light backscattered from an output window 31, a conditioning lens or other optical element placed in front of the LED emitters. In an alternative configuration, if the light from the LED emitter is guided by an optical component in its path, such as is typically the case with a plastic output window, then the color sensor 27 may be positioned at an extremity of this output window 31, to receive a part of the guided light. In all of the illustrated embodiments, the color sensor is connected to the controller 30 to provide data signals thereto. Of course, one skilled in the art will readily understand that a variety of other configurations incorporating a color sensor within a LED lighting system are possible without departing from the scope of the invention.

Method for Operating a LED System

In accordance with embodiments of the present invention, there is provided a method for operating a LED lighting system at a target output color, the LED system having three or more LED emitters emitting light of different colors combined into a light output. As explained above, each LED emitter is operable at a controllable emitter drive setting, for example a constant current value in a CC driving scheme, or a current modulation duty cycle in a PWM driving scheme. The LED lighting system further includes a color sensor.

Although the method is described herein as applied to lighting systems such as those shown in FIGS. 2A to 2D, it will be readily understood that other embodiments of the present method may be used to control LED lighting systems having different configurations.

Calibration Data and Calibration Matrices

The method first includes a step of providing calibration data and one or more calibration matrices.

The calibration data includes values for the light output of the LED lighting system measured for a plurality of values of the drive settings of said emitters.

In some implementations, the values for the light output may have been measured by a spectrometer. As known in the art, spectrometers are devices providing the spectral intensity profile of a light beam. Since recording spectra can require significant processing and storage capacity, it can be preferable to provide these values of the calibration data in the form of absolute color point coordinates in an absolute color space. In accordance with one embodiment, the absolute color point coordinates may be tristimulus coordinates X, Y and Z in the CIE 1931 XYZ color space. As mentioned above, the tristimulus coordinates are defined relative to color matching functions related to the perception of colors by the photoreceptors, or cones, of the human eye. By definition, the Y coordinate corresponds to the luminance, Z is nearly equal to blue stimulation and X is a mix of cone response curves chosen to be non-negative.

From a recorded light spectrum S(λ) the tristimulus coordinates are calculated as follows:

$$X = k_c \int_\lambda S(\lambda) \cdot CMF_X(\lambda)\, d\lambda \qquad (2)$$

$$Y = k_c \int_\lambda S(\lambda) \cdot CMF_Y(\lambda)\, d\lambda$$

$$Z = k_c \int_\lambda S(\lambda) \cdot CMF_Z(\lambda)\, d\lambda$$

where $k_c$ is a constant, $CMF_X$, $CMF_Y$ and $CMF_Z$ are the color matching functions specified by the CIE and λ represents the light wavelength.

In other implementations, a calibrated colorimeter could also be used in place of the spectrometer to record the tristimulus coordinates for a plurality of values of the emitter drive settings.

The calibration data may therefore include the tristimulus coordinates $X_n$, $Y_n$ and $Z_n$ measured for the light output of the LED lighting system for each one of N values of the emitter drive settings. As explained below, this information may be used during operation of the LED system to determine initial drive settings for the emitters in view of the target color. Of course, the use of the standard CIE 1931 XYZ color space is shown here by way of example only, and in other embodiments any other convention allowing the calculation of absolute color point coordinates from the recorded spectra could be used.

The one or more calibration matrices define a relationship between measurements obtained from the color sensor of the LED lighting system, these measurements being represented by sensor color point coordinates, and absolute color point coordinates in an absolute color space. In some embodiments, the calibration matrices are pre-calculated as part of a calibration procedure that also involves measuring the light output of the LED lighting system with a spectrometer to obtain the calibration data. Such a calibration procedure further involves measuring the light output of the LED lighting system using the color sensor, and using both sets of data to calculate the calibration matrix or matrices. It should be noted that the color sensor used to obtain the data to generate the calibration matrices is the same color sensor providing feedback during operation of the LED lighting system. It has been found that significant variations can be observed in the outputs from different color sensors for a same light beam being measured, and that the calibration matrices should be device-specific in order to provide the desired degree of exactitude. Furthermore, it is preferred that the optical configuration used during the operation of the LED system be the same as the optical configuration used during the calibration process for measurements taken by the optical sensor. All the same components are therefore preferably used, i.e., the same LED emitters, the same color sensor, as well as the same additional optics such as lenses, mirrors and the like, all in a same position relative to one another.

As mentioned above, the measurements obtained from the color sensor of the LED lighting system are represented by sensor color point coordinates, that is, expressed as sensor color point coordinates in a sensor color space. For example, when the color sensor is embodied by a RGB sensor, the output thereof is expressed as R, G and B values for the light output.

Preferably, the relationships defined by the calibration matrix or matrices are calculated to be exact for at least one color point. Examples of such relationships will be provided further below in the context of two exemplary embodiments of the invention.

Calibration Matrix for a Specific Color

As mentioned above, the calibration matrix or matrices provide a transformation from the sensor color space, specific to the color sensor of the lighting system, to an absolute color space. In the example below, the sensor color space is embodied by a RGB space and the absolute color space by the standard CIE 1931 XYZ color space, although it will be readily understood that other conventions may be used without departing from the scope of the invention.

A common practice known in the art is to relate RGB and XYZ color spaces by a single linear matrix transformation. However, this practice introduces errors as the actual relationship between the two color spaces is not exactly linear. Furthermore, it can be shown that the calibration is highly dependent on the colors used to calculate the calibration matrix.

In view of the above, in one embodiment a calibration matrix relating non-linear functions of the sensor color point coordinates to the absolute color point coordinates may be provided. The calibration matrix may relate a system sensor vector, including the non-linear functions of the sensor color points coordinates, to a color vector, including the absolute color point coordinates. For example, the non-linear functions of the sensor color point coordinates may include second order terms of the sensor color point coordinates, which, in one simple form can be mathematically expressed as:

$$\begin{bmatrix} X \\ Y \\ Z \end{bmatrix} = A \begin{bmatrix} R \\ G \\ B \\ 1 \\ R^2 \\ G^2 \\ B^2 \end{bmatrix} \tag{3}$$

where the left-hand side vector is the color vector containing the absolute color point coordinates X, Y and Z, A is a 3×7 calibration matrix and the right-hand side vector is the sensor vector containing both first- and second-order terms of the sensor color point coordinates R, G and B. Optionally, the sensor vector may further include a constant term compensating for dark current effects, such as the "1" in the middle of the sensor vector of equation (3) above. One skilled in the art will readily understand that although a color sensor measuring three different colors is presented herein, the same principles would apply to sensors having a greater number of channels.

In some variants of this embodiment, a single calibration matrix may be provided for the LED lighting system, preferably associated with an average operation temperature of the system. In other variants, a plurality of calibration matrices may be provided, each associated with a different operation temperature of the LED lighting system.

In some embodiments, the calibration matrix A is obtained from a network of test color points spanning a test region surrounding a calibration color point.

To obtain the elements of the calibration matrix, calibration data for several color points can be used. For example, for a minimum of seven color points, equation (3) can be rewritten as follows:

$$\begin{bmatrix} X_1 & X_2 & \dots & X_n \\ Y_1 & Y_2 & \dots & Y_n \\ Z_1 & Z_2 & \dots & Z_n \end{bmatrix} = A \begin{bmatrix} R_1 & R_2 & \dots & R_n \\ G_1 & G_2 & \dots & G_n \\ B_1 & B_2 & \dots & B_n \\ 1 & 1 & \dots & 1 \\ R_1^2 & R_2^2 & \dots & R_n^2 \\ G_1^2 & G_2^2 & \dots & G_n^2 \\ B_1^2 & B_2^2 & \dots & B_n^2 \end{bmatrix} \tag{4}$$

where the indices 1 to n represent the different color points used for the calibration. In one embodiment, a solution for the calibration matrix A can be calculated using:

$$A = \begin{bmatrix} X_1 & X_2 & \dots & X_n \\ Y_1 & Y_2 & \dots & Y_n \\ Z_1 & Z_2 & \dots & Z_n \end{bmatrix} \begin{bmatrix} R_1 & R_2 & \dots & R_n \\ G_1 & G_2 & \dots & G_n \\ B_1 & B_2 & \dots & B_n \\ 1 & 1 & \dots & 1 \\ R_1^2 & R_2^2 & \dots & R_n^2 \\ G_1^2 & G_2^2 & \dots & G_n^2 \\ B_1^2 & B_2^2 & \dots & B_n^2 \end{bmatrix}^+ \quad (5)$$

where the superscript+ refers to the Moore-Penrose pseudo-inverse defined by:

$$N^+=(N^TN)^{-1}N^T \quad (6)$$

where N is a matrix having more columns than lines. Other solutions to the system of equation (5) can alternatively be used to calculate the calibration matrix A, as will be readily understood by one skilled in the art.

The choice of the color points in the network of test color points used to calculate the calibration matrix can have a significant impact of the performance of the color sensor. It can be shown that using points that are close to one single color will give a calibration that is exact only for this specific color. A network defining a broader color sample is therefore preferred—however, if the test color points are too far apart, the precision of the calibration will be lesser for the entire test region. The test color points are therefore preferably selected to strike a balance between these competing requirements. It can also be shown that the test region should preferably span the entire luminous region to be controlled by the color sensor. For example, the selected points may have color values distributed between $-20<a^*<20$ and $-20<b^*<20$ in the CIELab diagram, and/or a luminosity range corresponding to the luminance range of the target application, such as Y values between 5 cd/m$^2$ and 30 cd/m$^2$ in one implementation. Finally, simulations have shown that a minimum of thirty test color points are preferably used to calculate the calibration matrix. This allows the calibration matrix to better represent the average variations observed during the operation of the lighting system.

The above requirements for a good calibration do not include the placements of the individual points within the network. In most embodiments, as long as the test color points spawn a large enough area, they can be located at random.

The calibration data and the data used to calculate the calibration matrix can be obtained through a suitable calibration process. In accordance with one embodiment of the invention, such a calibration process may include the two phases described below, that is, a pre-calibration phase providing a relationship between the drive settings applied to the LED emitters and the output color of the lighting system, and a calibration phase where calibration data for the network of test points is obtained and the calibration matrix is calculated.

Figure 3A:
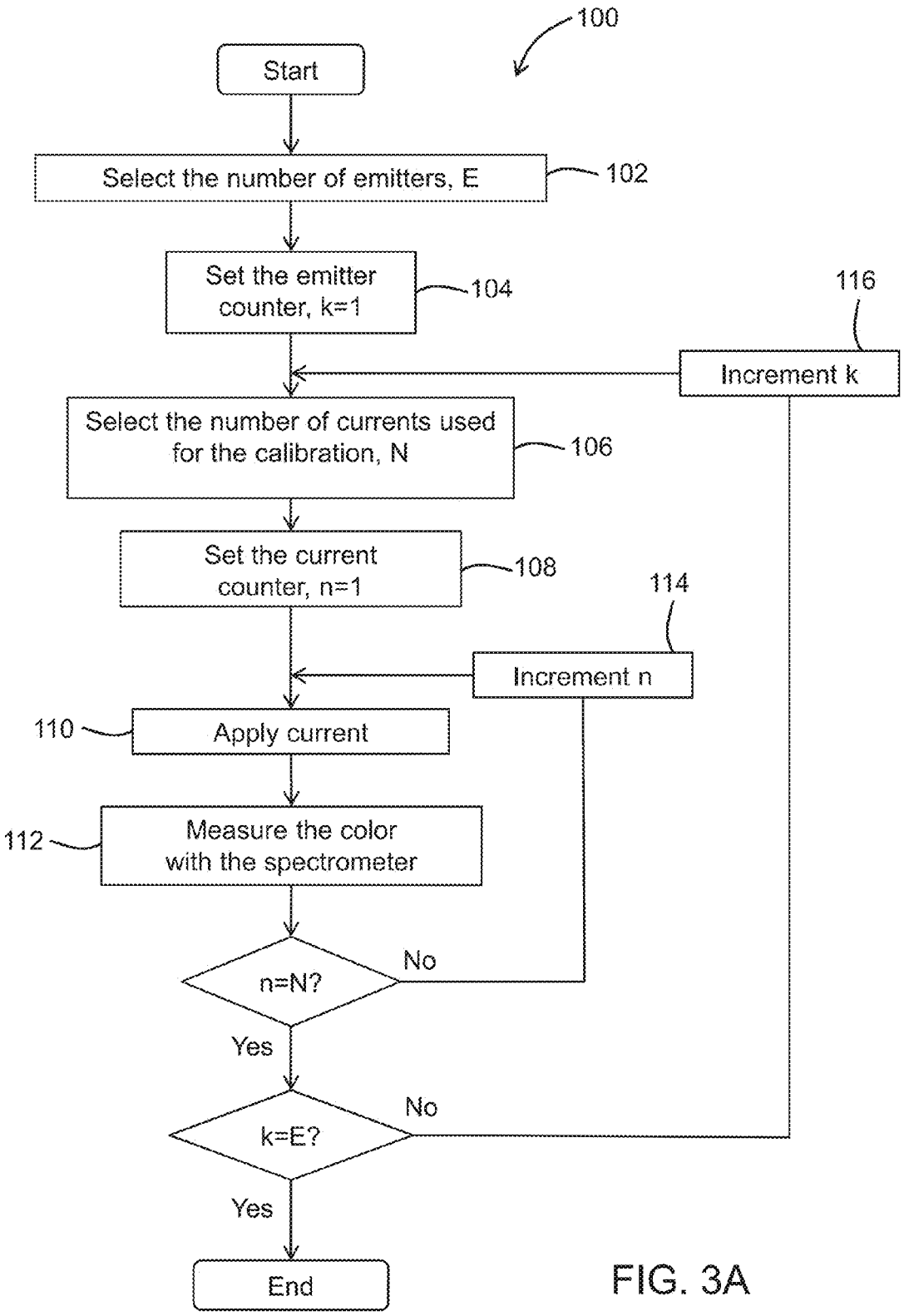
FIG. 3A is a flow chart of a pre-calibration phase for obtaining calibration data and FIG. 3B is a flow chart of a calibration phase for calculating one of more calibration matrices for a specific color, according to one embodiment.

Referring to FIG. 3A, the pre-calibration phase 100 of an implementation of the calibration process is illustrated. The pre-calibration phase 100 first involves a step 102 of selecting the number E of LED emitters in the lighting system. For example, in the case of a RGB system such as shown in FIG. 2A, E would be set to 3. A number of calibration values are to be obtained for each emitter, as tallied by an emitter counter k first set to 1 (step 104). For a given emitter, a number N of drive settings, for example the driving current of the corresponding emitter, is selected (step 106), and a current counter n set to 1 (step 108). For each increment of the current counter n, the corresponding drive current is applied (step 110) to the corresponding emitter, and a spectrum is measured with a spectrometer (step 112). The absolute color coordinates corresponding to each measured spectrum can be calculated using the CIE colorimetric functions and equation (2) above. The current counter n is incremented (step 114) and a next spectrum is measured until the maximum number of currents N has been reached. Once the absolute color coordinates have been obtained for all the current values for a given emitter, the emitter counter k is in turn incremented (step 116) until all of the emitters have been processed.

As will be seen from the above description, the end of the pre-calibration stage may provide the calibration data relating the light output of the LED lighting system, when individual LED emitters are lit, to a plurality of values of the drive settings of the emitters. The pre-calibration phase is preferably performed at an average operation temperature, so that the average spectral shift of the LEDs is measured. Although this data will be used to determine a starting value for the drive settings in view of the target color during the operation of the lighting system, precision is not required since the present method provides fine tuning of the drive settings through the use of the color sensor, as explained below.

Figure 3B:
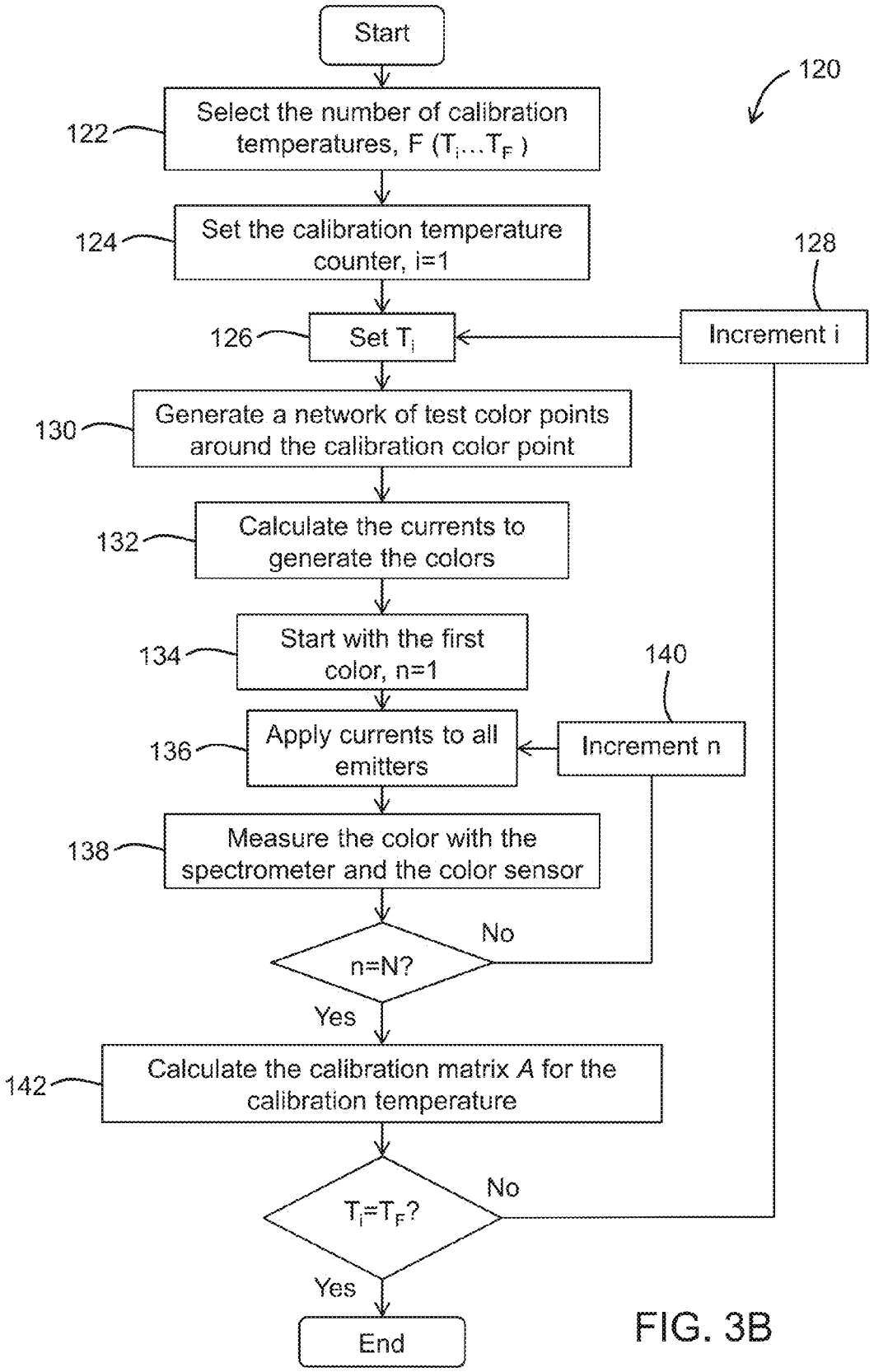

Referring to FIG. 3B, there is shown a flow chart of the calibration phase 120 of the calibration process. In this phase, values for the light output of the LED lighting system using both the device-specific color sensor and the spectrometer are obtained, and this information is used to calculate the calibration matrix.

Figure 11:
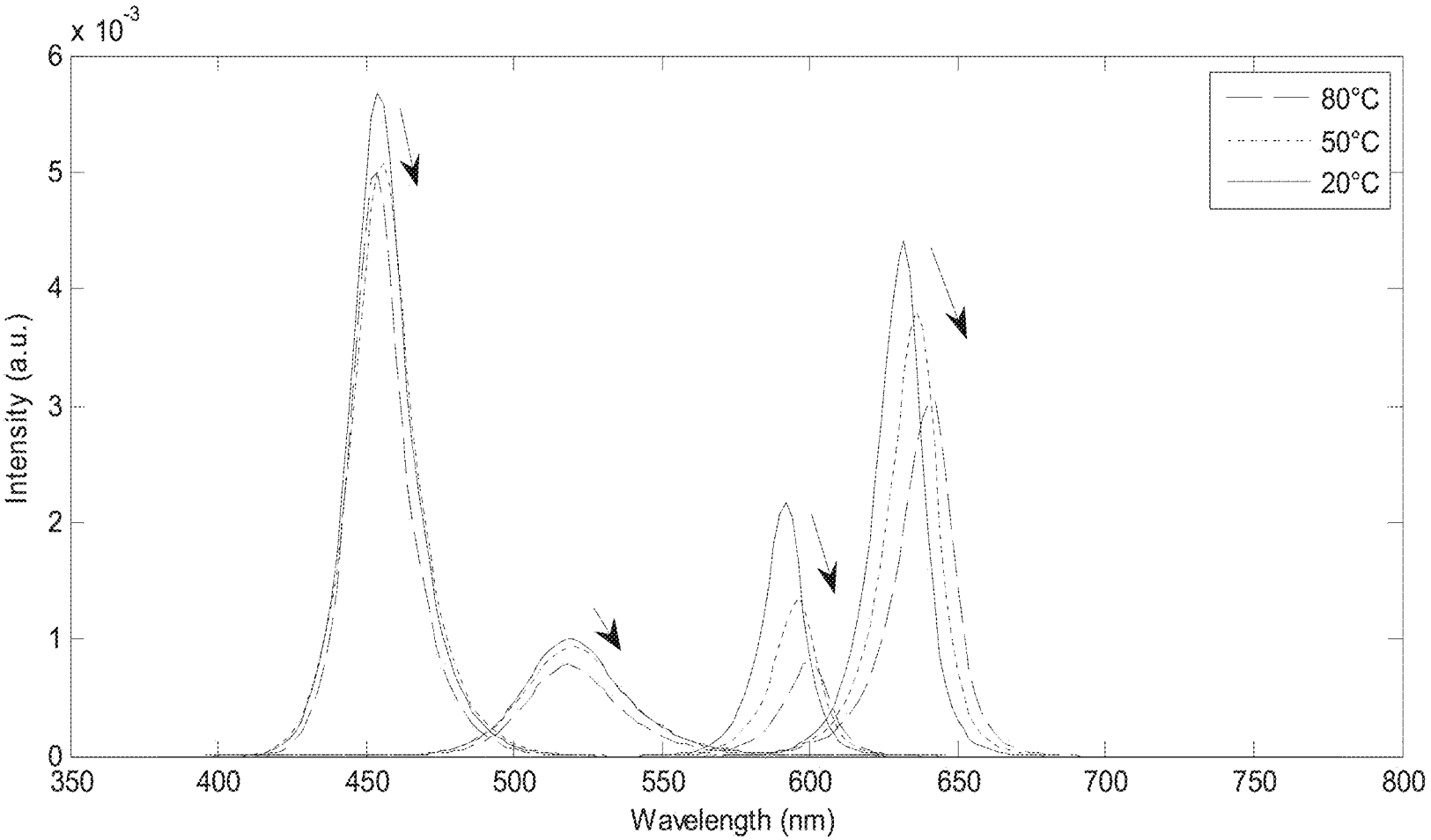
FIG. 11 shows intensity spectra measured from a RGBA LED operated at temperatures of 20° C., 50° C. and 80° C., respectively.

Optionally, in the case where calibration matrices are desired for different temperature values, the corresponding number F of calibration temperatures, and therefore, the number of calibration matrices to calculate, is selected as a preliminary step 122. The provision of one or more calibration matrices may be determined based on the expected range of the operation temperature of a particular LED lighting system. By way of reference, FIG. 11 illustrates the shift in the spectra of a RGBA LED with temperature. It can be seen that the shift is non-linear and that it varies from emitter to emitter. If only one calibration matrix is used, the temperature can be selected in the middle of the operation temperature range, for example 50° C. for operations between 20° C. and 80° C. Otherwise, representative values spanning the range of temperatures at which the lighting system is to be operated may be selected. A temperature counter i is set to 1 (124), and the corresponding temperature $T_i$ is set 126. The steps that follow are performed for each desired value of $T_i$, the temperature counter i being incremented (step 128) after each iteration.

Although not mentioned in the flow chart of FIG. 3B, if it has not yet been done the calibration process may include a step of selecting the specific calibration color point for which the calibration will be performed, which is preferably the same or close to the target color for at which the LED lighting system is to be operated. It should be noted that various colors close to the selected one will also be controllable by the system within an acceptable degree of precision.

The calibration next involves generating a network of test color points spanning a test region surrounding the calibration color point (130). Preferably, the network includes a number N of at least 30 points tallied by color point counter n=1 . . . 30. The distribution of the test color points around the calibration color point is preferably uniform, and may be random or selected according to a specific pattern.

The calibration process next includes calculating the drive settings needed to attain each test color point (132). This is preferably accomplished using the calibration data obtained through the pre-calibration process above. The drive settings are calculated by solving the matrix system of equation (1), reproduced here for convenience:

$$\begin{bmatrix} X \\ Y \\ Z \end{bmatrix}_{target} = \begin{bmatrix} X_1 & & X_k \\ Y_1 & \dots & Y_k \\ Z_1 & & Z_k \end{bmatrix} \cdot \begin{bmatrix} C_1 \\ \vdots \\ C_k \end{bmatrix}. \tag{7}$$

where X, Y, Z are the absolute color coordinates of the target color, $X_k$, $Y_k$ and $Z_k$ are the absolute color coordinates of each individual LED emitter k (in "fully on" condition) and $C_k$ are weight coefficients which can take a value between 0 and 1. The $C_k$ coefficients are related to the emitters drive settings: a coefficient set to 1 correspond to a fully lit up emitter, a coefficient set to 0 corresponds to an emitter in off condition and intermediate values correspond to a proportionally dimmed emitter, with luminance $Y_k$ reduced by a factor $C_k$.

In the illustrated example, the drive settings are embodied by current values applied to each LED emitter. In embodiments where the LED lighting system includes only three LED emitters, for example R, G and B emitters, the solution of the matrix system of equation (7) is unique, that is, a single set of $C_k$ coefficients, and therefore of drive settings, corresponds to each target color point. If the lighting system contains more than three LED emitters, however, an infinite number of solutions exist for each color point. Various schemes are known to those skilled in the art in order to select a preferred or optimal solution. A common choice is to use the Moore-Penrose pseudo-inverse to find a solution. Another approach could be to find the solution that optimizes a parameter related to a color rendering metric, such as a Color Rendering Index (CRI) or a Color Quality Scale (CQS).

Starting with the first color point n=1 (134), the calibration process next involves applying (136) the drive settings associated with this color point to all the LED emitters of the lighting system. The light output of the LED lighting system is measured (138) using both the spectrometer and the color sensor. The color point counter n is incremented (140) and steps 136 and 138 are repeated for each of the N test color points. Values for all the $X_n$, $Y_n$ and $Z_n$ on the one hand, and $R_n$, $G_n$ and $B_n$ on the other hand, are therefore obtained.

Next, the calibration matrix A associated with the applied temperature is calculated (142). This may for example be accomplished using equation (5) and the values for all the $X_n$, $Y_n$ and $Z_n$ and $R_n$, $G_n$ and $B_n$ obtained from the previous step.

At the end of the process, the calibration matrix or matrices and calibration data for the light output of the LED lighting system measured using a spectrometer in the calibration phase are stored in the memory, for use during the operation of the LED lighting system.

Calibration Matrices for Individual LED Emitters

A LED lighting system can typically be characterized by its color gamut, that is, the range of colors it can produce. In some implementations, it may be desirable to provide a calibration for a LED lighting system that is valid and precise for the entire gamut of the lighting system, or at least within a portion thereof larger than the colors close to a specific calibration color point such as provided for in the previous section.

It can be shown that by using a single calibration matrix defining a linear or non-linear relationship between the absolute color coordinates and the sensor color coordinates, the obtained calibration is precise within a limited color gamut. This can be observed from the following considerations.

Taking the RGBW LED lighting system of FIG. 2B by way of example, the different absolute color coordinates of the lighting system can be developed for every LED emitter as follows:

$$X=X_r+X_g+X_b+X_w$$

$$Y=Y_r+Y_g+Y_b+Y_w$$

$$Z=Z_r+Z_g+Z_b+Z_w \tag{8}$$

where r, g, b and w are indices representing the four LED emitters. The same principle can be applied to represent the different sensor color point coordinates outputted by the color sensor, such that $$R=R_r+R_g+R_b+R_w$$

$$G=G_r+G_g+G_b+G_w$$

$$B=B_r+B_g+B_b+B_w \tag{9}$$

Traditional calibration procedures relate RGB values to absolute color coordinates linearly through a transformation matrix A, such that $$\begin{bmatrix} X \\ Y \\ Z \end{bmatrix} = \begin{bmatrix} a_{11} & a_{12} & a_{13} \\ a_{21} & a_{22} & a_{23} \\ a_{31} & a_{32} & a_{33} \end{bmatrix} \begin{bmatrix} R \\ G \\ B \end{bmatrix} \tag{10}$$

By combining equations (9) and (10) the X coordinate may be represented as:

$$X=a_{11}(R_r+R_g+R_b+R_w)+a_{12}(G_r+G_g+G_b+G_w)+a_{13}(B_r+B_g+B_b+B_w) \tag{11}$$

Taking under consideration equation (8) it can be assumed that, for the red emitter:

$$X_r=a_{11}R_r+a_{12}G_r+a_{13}B_r \tag{12}$$

And so forth for all the LED emitters. Repeating this procedure for the $Y_r$ and $Z_r$ absolute color coordinates, the relationship between the absolute color point coordinates and the sensor color coordinates for the red emitter can be expressed as:

$$\begin{bmatrix} X_r \\ Y_r \\ Z_r \end{bmatrix} = \begin{bmatrix} a_{11} & a_{12} & a_{13} \\ a_{21} & a_{22} & a_{23} \\ a_{31} & a_{32} & a_{33} \end{bmatrix} \begin{bmatrix} R_r \\ G_r \\ B_r \end{bmatrix} \tag{13}$$

The same form would apply for the other three LED emitters G, B and W.

It can be observed from the above considerations that the same matrix is used to relate the different color spaces for each emitter. However, in order to correctly represent the behavior of the LED emitters this transformation should vary from one LED emitter to another. The linear transformation approach can therefore be viewed as an average of all the individual matrices of the different emitters. More specifically, if A is the transformation matrix used in Equation (10), such that:

$$\begin{bmatrix} X \\ Y \\ Z \end{bmatrix} = A \begin{bmatrix} R \\ G \\ B \end{bmatrix} \tag{14}$$

then the average matrix A can be expressed in terms of the individual transformation matrices for the r g b and w emitters $A_k$:

$$A = \frac{\sum_k A_k \begin{bmatrix} R_k \\ G_k \\ B_k \end{bmatrix} \begin{bmatrix} R \\ G \\ B \end{bmatrix}^T}{R^2 + G^2 + B^2} \tag{15}$$

where k=r, g, b, w is an index representing one of the LED emitters, $A_k$ is the emitter calibration matrix associated with the LED emitter represented by index k, $R_k$, $G_k$ and $B_k$ are the sensor color point coordinates for light from the LED emitter represented by index k, the superscript T represents vector transpose and R, G and B represent the output coordinates of the color sensor for the light output of the entire system.

Therefore, in accordance with another embodiment, the one or more calibration matrices may include a plurality of emitter calibration matrices, each associated with an individual LED emitter.

Preferably, each emitter calibration matrix defines a relationship between an emitter sensor vector comprising the sensor color point coordinates for the associated individual one of the LED emitters, and an emitter color vector comprising the absolute color point coordinates for the associated individual one of the LED emitters. Mathematically, this relationship corresponds to:

$$\begin{bmatrix} X_r \\ Y_r \\ Z_r \end{bmatrix} = A_r \begin{bmatrix} R_r \\ G_r \\ B_r \end{bmatrix} \tag{16}$$

$$\begin{bmatrix} X_g \\ Y_g \\ Z_g \end{bmatrix} = A_g \begin{bmatrix} R_g \\ G_g \\ B_g \end{bmatrix}$$

$$\begin{bmatrix} X_b \\ Y_b \\ Z_b \end{bmatrix} = A_b \begin{bmatrix} R_b \\ G_b \\ B_b \end{bmatrix}$$

$$\begin{bmatrix} X_w \\ Y_w \\ Z_w \end{bmatrix} = A_w \begin{bmatrix} R_w \\ G_w \\ B_w \end{bmatrix}$$

Or, in compacted form:

$$\begin{bmatrix} X_k \\ Y_k \\ Z_k \end{bmatrix} = A_k \begin{bmatrix} R_k \\ G_k \\ B_k \end{bmatrix} \tag{17}$$

where k=r, g, b, w is an index representing one of the LED emitters, $A_k$ is the emitter calibration matrix associated with the LED emitter represented by index k, $R_k$, $G_k$ and $B_k$ are the sensor color point coordinates for light from the LED emitter represented by index k, and $X_k$, $Y_k$ and $Z_k$ are the absolute color point coordinates for the light from the LED emitter represented by index k.

The overall relation between the two color spaces can be written as:

$$\begin{bmatrix} X \\ Y \\ Z \end{bmatrix} = A_r \begin{bmatrix} R_r \\ G_r \\ B_r \end{bmatrix} + A_g \begin{bmatrix} R_g \\ G_g \\ B_g \end{bmatrix} + A_b \begin{bmatrix} R_b \\ G_b \\ B_b \end{bmatrix} + A_w \begin{bmatrix} R_w \\ G_w \\ B_w \end{bmatrix} \tag{18}$$

Accordingly, the X coordinate can therefore be expressed as follows:

$$X = a_{11}{}^r R_r + a_{11}{}^g R_g + a_{11}{}^b R_b + a_{11}{}^w R_w + a_{12}{}^r G_r + a_{12}{}^g G_g + a_{12}{}^b G_b + a_{12}{}^w G_w + a_{13}{}^r B_r + a_{13}{}^g B_g + a_{13}{}^b B_b + a_{13}{}^w B_w \tag{19}$$

with $a_{mn}{}^k$ for k=r, g, b, w representing the matrix element of the different emitter calibration matrices. A similar expression will readily be developed for the Y and Z absolute color coordinates.

It will be readily seen that equation (19) contains a lot more information than the previous case expressed by equation (11). It will also be understood that using this approach, the values obtained for the calibration will be valid for any target color, throughout the gamut of the lighting system. This may be intuitively understood by considering the case where a color approaches the edge of the gamut where only one emitter is turned on, the matrix that will be used is the one of the emitter—the absolute color point coordinates for the light associated with the other LED emitters will tend to zero, and only the terms of the calibration matrix associated with the lit emitter will contribute to the color conversion.

In one variant, each emitter sensor vector may further include a constant term compensating for dark current effects, such as for example:

$$\begin{bmatrix} X_k \\ Y_k \\ Z_k \end{bmatrix} = A_k \begin{bmatrix} R_k \\ G_k \\ B_k \\ 1 \end{bmatrix} \tag{20}$$

The constant term compensates for the dark current, that is, the signal outputted by the corresponding emitter when it is turned "off".

In another variant, each emitter calibration matrix may relate an emitter sensor vector comprising non-linear functions of the sensor color point coordinates to a color vector comprising the absolute color point coordinates. The non-linear functions of the sensor color point coordinates may for example include second order terms, such as:

$$\begin{bmatrix} X_k \\ Y_k \\ Z_k \end{bmatrix} = A_k \begin{bmatrix} R_k \\ G_k \\ B_k \\ 1 \\ R_k^2 \\ G_k^2 \\ B_k^2 \end{bmatrix} \tag{21}$$

Such an embodiment may be particularly advantageous for LED emitters having large spectral variations with their drive settings. It will be readily understood that the relationship defined by the emitter calibration matrices may take other mathematical forms without departing from the scope of the invention.

As with the previously described embodiment, a suitable calibration process is preferably performed to obtain the calibration data, i.e., providing values for the light output of the LED lighting system for a plurality of values of the emitter drive settings, and calculate the emitter calibration matrices.

Figure 4:
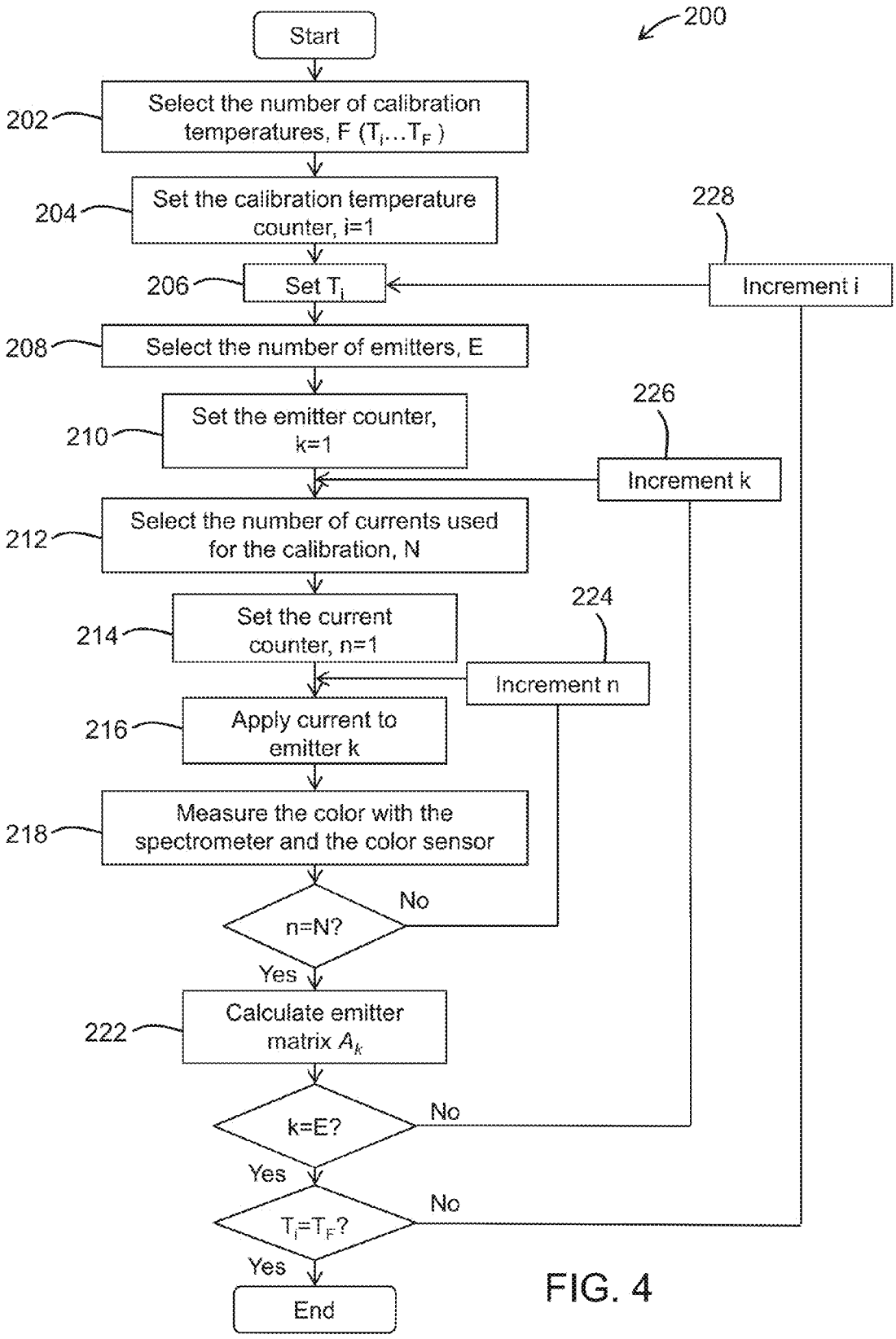
FIG. 4 is a flow chart of a calibration process to obtain calibration matrices for individual LED emitters, according to another embodiment.

Referring to FIG. 4, a flow chart of a calibration process 200 according to one embodiment is illustrated.

Optionally, in the case where emitter calibration matrices are desired for different temperature values, the corresponding number F of calibration temperatures, and therefore, the number of sets of emitter calibration matrices to calculate, is selected as a preliminary step 202. If only one set of emitter calibration matrices is used, the calibration temperature may be selected as the average operation temperature, for example 50° C. for operation between 20° C. and 80° C. Otherwise, representative values spanning the range of temperatures at which the lighting system is to be operated may be selected—for example 30° C., 50° C. and 70° C. A temperature counter i is set to 1 (204), and the corresponding temperature $T_i$ is set (206). The steps that follow are performed for each desired value of $T_i$, the temperature counter i being incremented (step 228) after each iteration.

The calibration process 200 then involves a step 208 of selecting the number E of LED emitters in the lighting system. For example, in the case of a RGB system such as shown in FIG. 2A, E would be set to 3. A number of calibration values are to be obtained for each emitter, as tallied by an emitter counter k first set to 1 (step 210).

For a given emitter, a number N of drive settings, for example the driving current of the corresponding emitter, is selected (step 212), and a current counter n set to 1 (step 214). For each increment of the current counter n, the corresponding drive current is applied (step 216) to the corresponding emitter, and the light output of the lighting system is measured (218), using both spectrometer and color sensor. The absolute color coordinates corresponding to each spectrum measured by the spectrometer can be calculated using the CIE colorimetric functions and equation (2) above. The current counter n is incremented (step 224) until the maximum number of currents N has been reached.

Once all the data related to a given emitter has been obtained, the emitter calibration matrix $A_k$ for the current emitter k can be calculated (222). For example, the relationship defined by equation (20) above can be expressed as:

$$\begin{bmatrix} X_1 & X_2 & \dots & X_n \\ Y_1 & Y_2 & \dots & Y_n \\ Z_1 & Z_2 & \dots & Z_n \end{bmatrix} = A_k \begin{bmatrix} R_1 & R_2 & \dots & R_n \\ G_1 & G_2 & \dots & G_n \\ B_1 & B_2 & \dots & B_n \\ 1 & 1 & 1 & 1 \end{bmatrix} \tag{22}$$

where the indices 1 . . . n represent the N different currents used during the previous steps of the calibration, and the calibration matrix $A_k$ can now be calculated using:

$$A_k = \begin{bmatrix} X_1 & X_2 & \dots & X_n \\ Y_1 & Y_2 & \dots & Y_n \\ Z_1 & Z_2 & \dots & Z_n \end{bmatrix} \begin{bmatrix} R_1 & R_2 & \dots & R_n \\ G_1 & G_2 & \dots & G_n \\ B_1 & B_2 & \dots & B_n \\ 1 & 1 & 1 & 1 \end{bmatrix}^+ \tag{23}$$

where the superscript+ refers to the Moore-Penrose pseudo-inverse as defined in equation (6) above. Of course, those skilled in the art will readily understand that other solutions to the system can also be used to calculate the emitter calibration matrix $A_k$.

Once the absolute and sensor color coordinates have been obtained and the emitter calibration matrix been calculated for all the current values for a given emitter, the emitter counter k is then incremented (step 226) until all of the emitters have been processed. The emitter calibration matrices, the absolute color coordinates and the sensor color coordinates for all the drive settings used during the calibration process are kept in memory. As will be explained further below, the calibration matrices and the sensor color coordinates will be used to obtain the absolute color coordinates X, Y and Z from the measured sensor color coordinates R, G and B during the control phase, while the calibration data for different drive settings will be used to estimate the currents to apply to the different LED emitters to achieve the desired target color.

Control Phase

Figure 5:
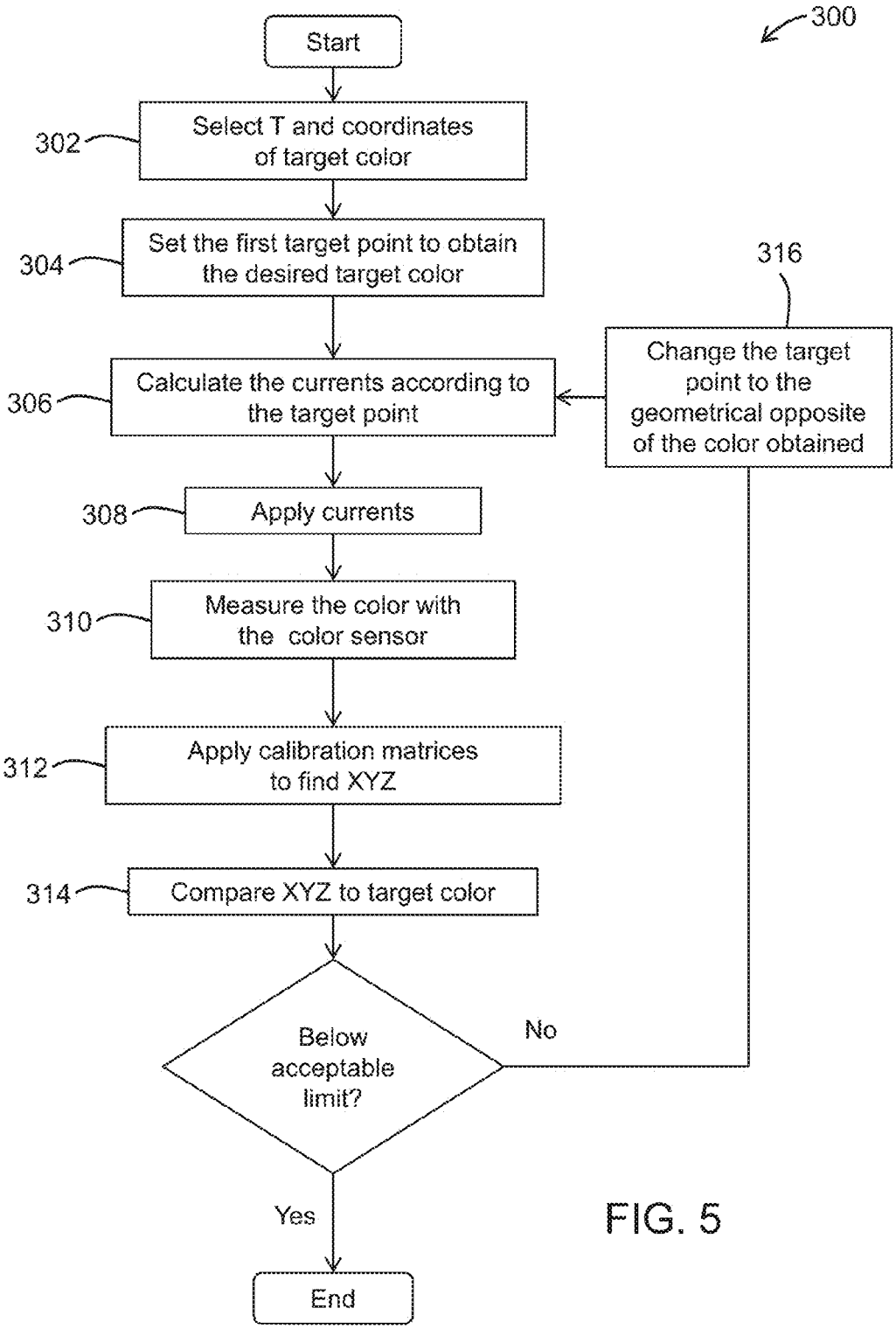
FIG. 5 is a flow chart of a control phase of a method for operating a LED lighting system according to one embodiment.

Referring to FIG. 5, there is shown an algorithm of a control phase 300 of the method for operating a LED lighting system at a target output color according to one embodiment.

The method generally includes operating the LED emitters at drive settings selected in view of the target output color and based on the calibration data and calibration matrix or matrices.

In the illustrated embodiment, this first involves selecting (step 302) color coordinates of the target color. The color coordinates are preferably in an absolute color space, such as the CIE 1931 XYZ or CIELAB color spaces. Optionally, if calibration matrices are available for several temperatures, the operation temperature T that will be considered in the process is also selected.

This step may for example involve measuring the junction temperature of the LED emitter or the temperature at a specific location within the LED lighting system, and identifying the calibration matrix or matrices that have been calculated for the calibration temperature closer to the desired operation temperature.

A first target color point is then set (304) to obtain the desired target color. The target color points may be expressed as coordinates in the same absolute color space as used for the calibration data, for ease of reference. Preferably, the first target color point is chosen to correspond to the same absolute color coordinates as the target color, or to the closest color point for which an entry exists in the calibration data.

The current or other drive settings to apply to each LED in order to obtain a light output having a color generally corresponding to the first target color point is then calculated (306). This process is the same as used for the calculation of the drive settings used during step (132) of the calibration phase of FIG. 3B. If the LED lighting system includes only three LED emitters, then there exists a single set of drive settings corresponding to the target color point, which can be directly extracted from the calibration data. If the LED lighting system includes a greater number of LED emitters, then an infinite number of solutions to the system of equations (20) theoretically exist and one should be chosen according to a predetermined criterion. For example, the Moore-Penrose pseudo-inverse may be used or a solution can be determined in view of optimizing a parameter related to a color rendering metric, such as a CRI or a CQS. If the calibration matrices have been calculated using calibration points chosen according to a particular solution for the sets of drive settings, then the same approach is preferably used during step 306 of the control phase.

Once the drive settings, here current values for each LED emitter, have been determined based on the target color point, these drive settings are applied to the LED emitters (308).

The method next involves measuring the sensor color point coordinates of the light output using the color sensor. In the present embodiment, R, G and B values for the overall light output of the LED lighting system are therefore obtained.

The method next involves (step 312) determining the absolute color point coordinates of the light output of the LED lighting system. This determination is based on the sensor color point coordinates R, G and B measured at the previous step, and on the calibration matrix or matrices associated with the operation temperature. In one exemplary embodiment, the absolute color point coordinates are expressed as X, Y and Z coordinates in the CIE 1931 XYZ color space.

The details of the calculations performed when applying the calibration matrices depend on the approach used to calculate the calibration matrices themselves.

In the case of the first embodiment described above, where there is one calibration matrix associated with a given operation temperature relating non-linear functions of the sensor color points coordinates to the absolute color point coordinates, the determining of step 312 may be embodied by a simple matrix operation. In one implementation, a system sensor vector containing both first and second order terms of the measured sensor color point coordinates R, G, and B is built, and multiplied with the calibration matrix, for example according to equation (3) above. Of course, the system sensor vector may take other forms containing non-linear functions of the sensor color point coordinates without departing from the scope of the present invention. If calibration matrices are available for different temperatures, the matrix that was obtained at the calibration temperature that is closest to the operation temperature is preferably used. In some implementations, if the operation temperature is between two calibration temperatures, the absolute color point coordinates may be calculated from a linear interpolation using the calibration matrices associated with both closest operation temperatures.

In the second embodiment described above, each calibration matrix is associated with an individual LED emitter of the lighting system, and the individual contribution $R_k$, $G_k$ and $B_k$ of each LED emitter to the overall sensor color point coordinates R, G, and B therefore needs to be obtained.

In one implementation, the determining of the absolute color point coordinates of the light output may include a substep of estimating or measuring the sensor color point coordinates of the light emitted from each LED emitter.

In variants where the LED emitters are driven using the PWM driving scheme, this may be accomplished by offsetting in time the pulses from the different LED emitters, so that the individual LED emitter contributions to the overall light output can be deduced from color sensor measurements taken at different moments over the PWM duty cycle (see for example U.S. Pat. No. 7,397,205).

Another approach could include driving each LED emitter with currents modulated at different frequencies and using a Fourier transform on the color sensor data to deduce the relative contribution from each frequency, containing the color information from each emitter (see U.S. Pat. No. 8,159,150).

Estimating the individual contributions from each emitter to the measured sensor color point coordinates may alternatively be performed based on calibration information. For example, in embodiments using the calibration process of FIG. 4, the calibration data may include values for the sensor color coordinates at each value of the drive settings for which calibration is performed, and this information may be used to interpolate the RGB values for each LED emitter at the applied currents. The interpolated RGB values for each emitter are then added and compared to the sensor color point coordinates measured by the color sensor. One skilled in the art will readily understand that the two values will not closely match, as there is a spectral shift if the junction temperatures differ from those used during the calibration phase, or as a result of aging. To take this shift into consideration, an error factor can be attributed in proportion to the relative intensities of the emitters. To find the relative intensities, the Y value may be interpolated at the applied current using the calibration data and then repeating this step for every emitter. The individual $R_k$, $G_k$ and $B_k$ values for each LED emitter are then corrected accordingly.

The determining of the absolute color point coordinates of the light output preferably includes a next substep of calculating the absolute color point coordinates of the light from each LED emitter $X_k$, $Y_k$ and $Z_k$ based on the sensor color point coordinates of the light emitted from the corresponding LED emitter $R_k$, $G_k$ and $B_k$ and the corresponding emitter calibration matrix $A_k$. In one embodiment, this may be performed by applying equation (20), or equation (21), or the like. A substep of calculating the absolute color point coordinates of the light output as the sum of the absolute color point coordinates of the light emitted from each of the LED emitters is then performed, according to:

$$\begin{bmatrix} X \\ Y \\ Z \end{bmatrix} = \sum_k \begin{bmatrix} X_k \\ Y_k \\ Z_k \end{bmatrix} \tag{24}$$

which is equivalent to equation (18) above.

As with the previous embodiment, if sets of emitter calibration matrices are available for different temperatures, the emitter calibration matrices that were obtained at the calibration temperature that is closest to the operation temperature are preferably used. In some implementations, if the operation temperature is between two calibration temperatures, absolute color point coordinates may be calculated from a linear interpolation using the sets of emitter calibration matrices associated with both closest operation temperatures.

The control phase 300 of the operation method finally includes step of comparing (314) the absolute color point coordinates determined at the previous step to the target color point coordinates representing the target color, to determine if a predetermined matching condition is met. The comparison is performed in a predefined color space, defining a comparison color space. Of course, if both coordinates are not provided in the same color space, a step of converting one set of coordinates is performed. For example, in one embodiment the target color may be expressed in color point coordinates in the CIELab color space, and the determined absolute color point coordinates obtained in the CIE 1931 XYZ color space are converted to CIELab before a comparison is made.

The comparison above may employ a predefined color difference formula valid in the comparison color space. For example, if the CIELab color space is used as comparison color space, one may calculate the color error by employing the CIE76 $\Delta E_{ab}^*$ color difference formula, which is defined as the Euclidean distance between the measured color point and the target color point in the CIELab space:

$$\Delta E_{ab}^* = \sqrt{(a_{target} - a_{measured})^2 + (b_{target} - b_{measured})^2 + (L_{target} - L_{measured})^2} \tag{25}$$

With this color difference formula, a difference of less than 2 will not be detected by an observer, so the matching condition in such an embodiment may be expressed as $\Delta E_{ab}^* \leq 2$.

If the obtained color is within reasonable proximity to the target color, then the matching condition is achieved and the currently applied settings are maintained.

Figure 6:
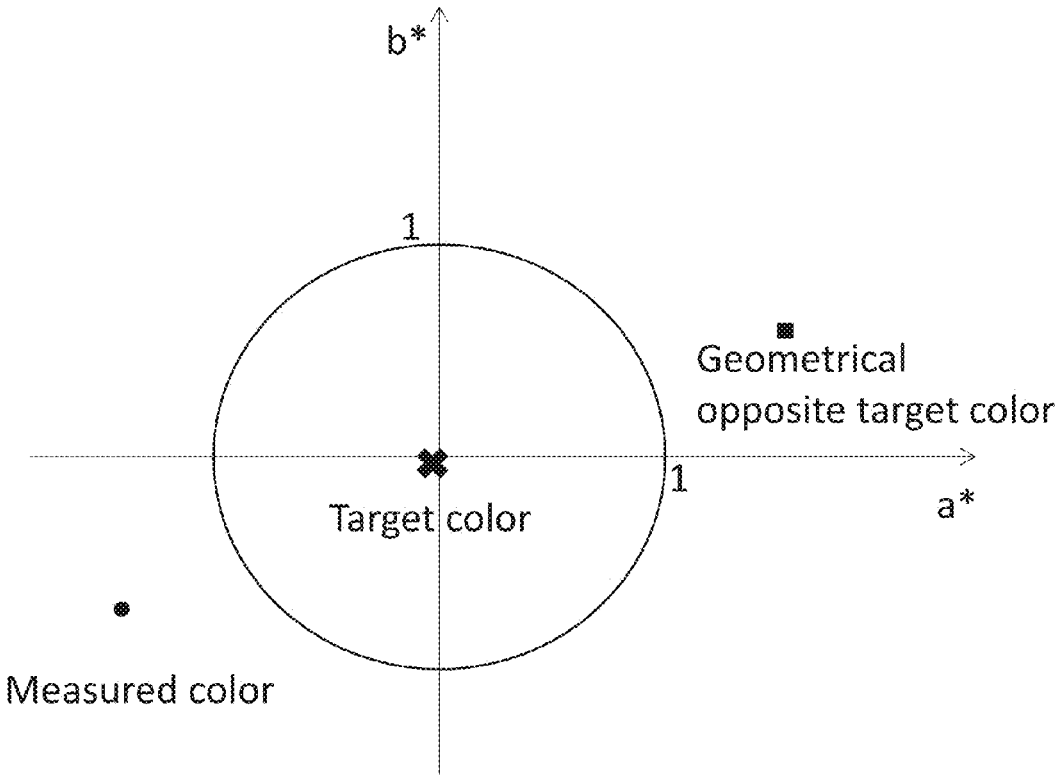
FIG. 6 schematically illustrates an example of shifting the target point to the geometrical opposite of the measured color.

If the matching condition is not considered achieved, however, different drive settings should be applied and tested according to the procedure detailed above. In one embodiment, the target color point based on which the new drive settings are determined may be selected as the geometrical opposite, in the corresponding absolute color space, to the target point used in the previous iteration (step 316). An example of the target color point selection is illustrated in FIG. 6. It is to note that the target color itself is not changed, only the target point used for the control phase. New operation drive settings are calculated (306) and applied (308) based on the new target color point and the remainder of the process is repeated to determine if these new drive settings allow achieving the desired target color.

Experimental Results

Implementations of the method and system described above were tested using a four-LED model XLamp MC-E RGBW Cold White available from Cree Inc. The color sensor used for both the calibration process and the control process was a JENCOLOR True Color MTCS sensor (tradename) from MAZeT GmbH.

Figure 7:
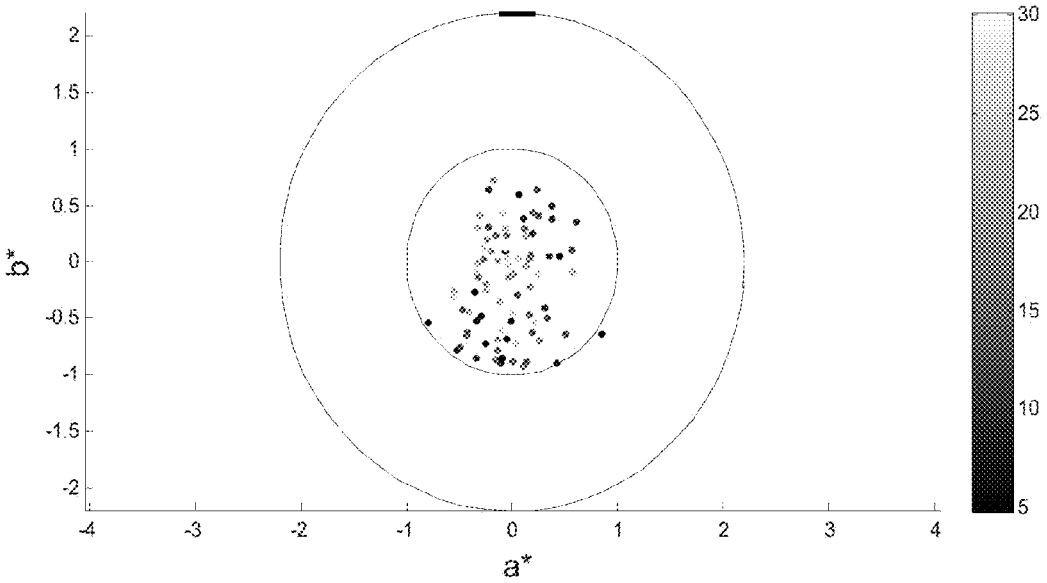
FIG. 7 shows the results of the color control using a calibration matrix based on one color and defining a non-linear relationship.

In a first series of experiments, the calibration approach for a single color using a calibration matrix providing the relationship of equation (3) was used. FIG. 7 shows results of the control process for an operation temperature ranging from 20° C. to 75° C. and luminosity ranging from Y=5 to Y=30. The small circle represents $\Delta E_{ab}$*=1, which is considered the maximum color variation for a light source observed directly, while the outer circle represents $\Delta E_{ab}$*=2.3, which is considered the maximum target color variation for a surface illuminated by the light source. These target color error values correspond to the limit of human perception to color error [M. Mahy, L. Van Eycken, and A. Oosterlinck, "Evaluation of uniform color spaces developed after the adoption of CIELAB and CIELUV," Color Res. Appl. 19, 105-121 (1994)]. The gray-scale bar represents luminosity. The target color corresponds to illuminant D65. An average error of $\Delta E_{ab}$*=0.49 was obtained with a maximum of $\Delta E_{ab}$*=1.06 with an average luminosity error of 0.51% and a maximum of 4.04%.

Figure 8:
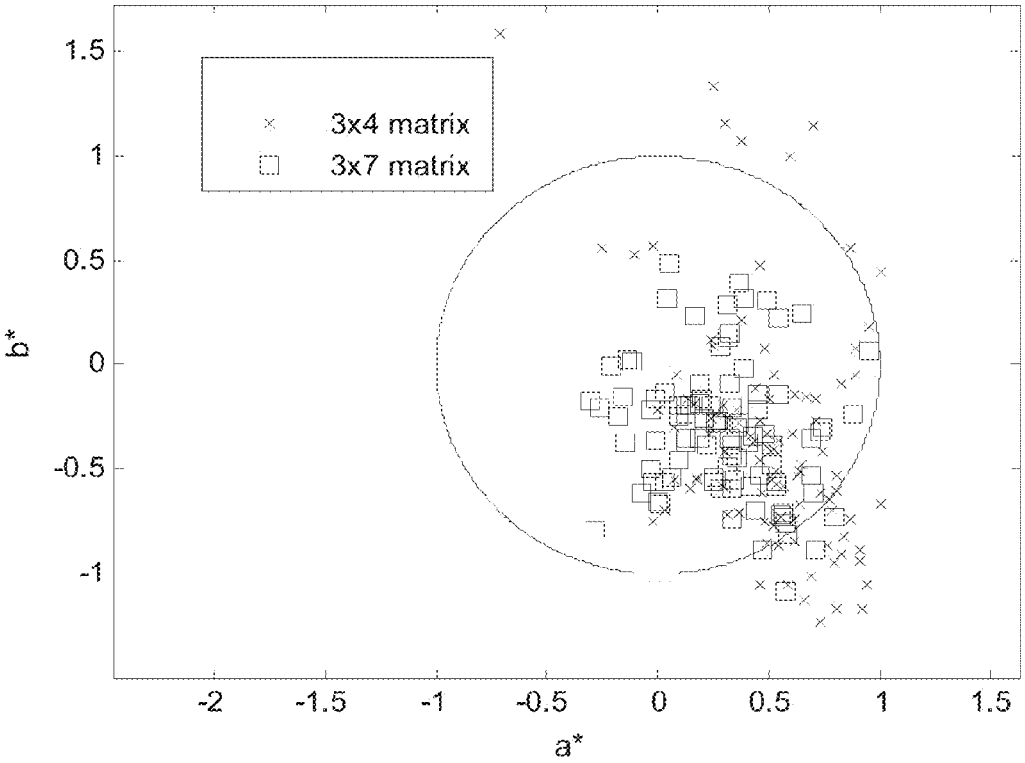
FIG. 8 presents a comparison of results obtaining using calibration matrices defining linear (3×4 matrix), and quadratic (3×7 matrix) relationships.

FIG. 8 presents a comparison of the use of calibration matrices for a specific color respectively defining linear (3×4 matrix) and quadratic (3×7 matrix) relationships between the absolute color point coordinates and the sensor color point coordinates. The circle represents the condition $\Delta E_{ab}$*=1. Points were taken at temperatures ranging from 20° C. to 75° C. It can be seen that the quadratic transformation gives the best results, but also that this approach provide best results for target colors within a limited range of the calibration color point.

Figure 9:
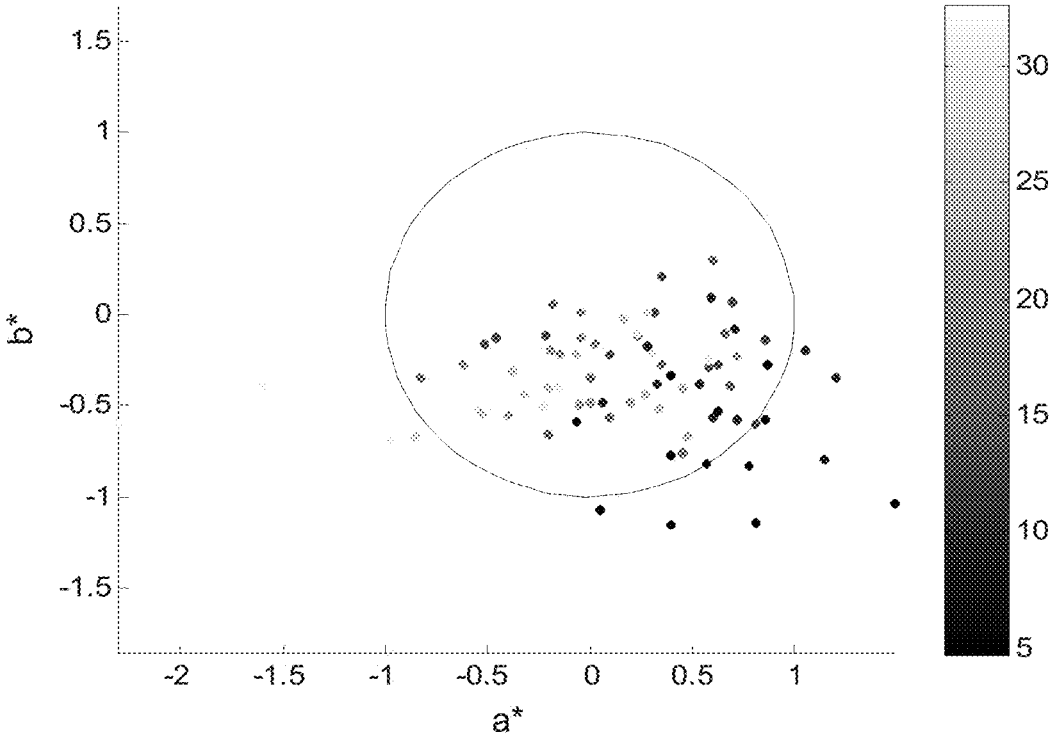
FIG. 9 shows the results of the color control using calibration matrices for each individual emitter.

Another set of experiments was performed using the same lighting system, but using a calibration process that provides calibration matrices for each individual emitter. FIG. 9 shows the results of this control process in similar conditions as with the previous experiments, that is for operation temperatures ranging from 20° C. to 75° C., luminosity ranging from Y=5 to Y=30 and a target color corresponding to illuminant D65. The circle represents $\Delta E_{ab}$*=1. An average error of ΔE*ab=0.69 was obtained with a maximum of ΔE*ab=2.38, with an average luminosity error of 0.56% and a maximum of 3.80%. The maximum error is clearly off target. However, it will be noticed that the points that give the largest errors are the ones with the lowest and highest luminosities, the former being affected by noise in the color detection and the latter being influenced by emitter spectral shifts due to variations of the junction temperature. Within a more limited luminosity region, every point fits within the acceptance circle.

Figure 10:
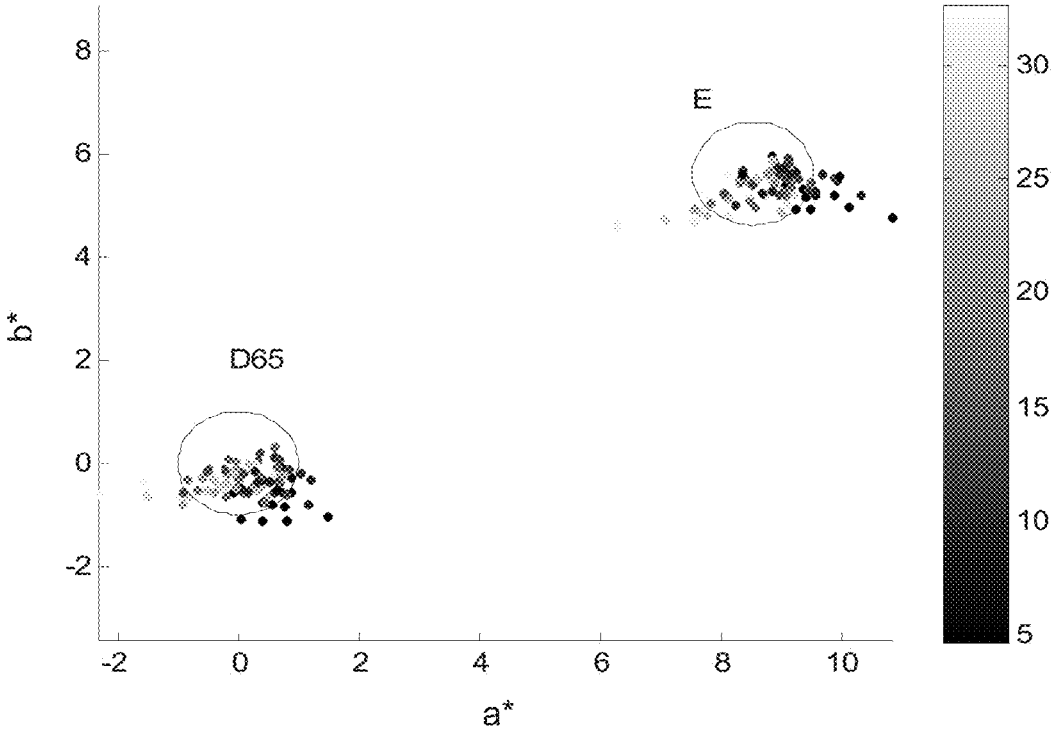
FIG. 10 shows the results of a control process similar to FIG. 9, except targeting both illuminants E and D65.

FIG. 10 shows results for two color controls targeting illuminants E and D65. No additional calibration is required to control a different color. An average error of ΔE*ab=0.71 was obtained with a maximum of ΔE*ab=2.38 with an average luminosity error of 0.76% and a maximum of 2.45%. It can be observed that there is almost no difference in error between the two targets. Table 1 present the results for targeting different CCTs.

TABLE 1

Results of the control phase targeting different CCTs

| CCT (K) | Average error ($\Delta E_{ab}$) | Maximum error ($\Delta E_{ab}$) | Average Y error (%) | Maximum Y error (%) |
|---|---|---|---|---|
| 2500 | 1.58 | 3.36 | 0.83 | 3.28 |
| 3000 | 1.23 | 3.39 | 0.79 | 3.03 |
| 3500 | 1.18 | 3.68 | 0.92 | 6.40 |
| 4000 | 0.99 | 3.26 | 0.83 | 5.48 |
| 4500 | 0.93 | 2.92 | 0.76 | 4.16 |
| 5000 | 0.80 | 2.11 | 0.59 | 2.21 |
| 5500 | 1.06 | 2.50 | 0.50 | 2.05 |
| 6000 | 1.26 | 4.38 | 0.72 | 5.22 |
| 8500 | 1.18 | 4.74 | 0.57 | 3.31 |
| 7000 | 1.19 | 4.24 | 0.51 | 2.29 |
| 7500 | 1.20 | 4.27 | 0.65 | 3.93 |

A slight decrease in performances can be observed compared to using D65 as the target color, but the errors are still within acceptable limits considering that the greatest error contributions come from the high and low luminosities and the much larger range of validity of the calibration with respect to the previous example, in which illuminant A (CCT of 2856 K) could not be reached.

By comparing the results for the two calibration approaches disclosed above, it appears that calibrating for a single color using a non-linear relationship provides better precision, but within a limited range, whereas using different calibration matrices for each LED emitter has no such range limitation. Both approaches could therefore be of interest depending on the circumstances of a particular implementation.

Of course, numerous modifications could be made to the embodiments described above without departing from the scope of the invention as defined in the appended claims.

The invention claimed is:

1. A method for operating a LED lighting system at a target output color, the LED system having three or more LED emitters emitting light of different colors combined into a light output, each LED emitter being operable at a controllable emitter drive setting, the LED lighting system further comprising a color sensor, the method comprising the steps of:

a) providing calibration data comprising values for the light output of said LED lighting system for a plurality of values of the emitter drive settings of said emitters, and further providing at least one calibration matrix defining a relationship between measurements obtained from the color sensor of the LED lighting system and represented by sensor color point coordinates, and absolute color point coordinates in an absolute color space;

b) operating the LED emitters at emitter drive settings selected in view of the target output color and based on the calibration data;

c) measuring the sensor color point coordinates of the light output using the color sensor;

d) determining the absolute color point coordinates of the light output based on the sensor color point coordinates measured at step c) and the at least one calibration matrix;

e) comparing the absolute color point coordinates determined at step d) to target color point coordinates representing said target color to determine if a predetermined matching condition is met, and, if not, repeating steps c) to e) using different operation drive settings.

2. The method according to claim 1, wherein the values for the light output of the LED lighting system provided in the calibration data comprise measurements of said light output using a spectrometer for each of the plurality of values of the emitter drive settings.

3. The method according to claim 1, wherein the values for the light output of the LED lighting system provided in the calibration data comprise measurements of said light output using a calibrated colorimeter for each of the plurality of values of the emitter drive settings.

4. The method according to claim 1, wherein said LED lighting system has a same optical configuration during operation as during a calibration process having provided the at least one calibration matrix.

5. The method according to claim 1, wherein each of the at least one calibration matrix relates non-linear functions of the sensor color point coordinates to the absolute color point coordinates.

6. The method according to claim 5, wherein, at step a), the plurality of values of the emitter drive settings of said emitters are settings values for which the light output generates a network of test color points spanning a test region surrounding a calibration color point.

7. The method according to claim 6, wherein said network comprises at least 30 of said test color points.

8. The method according to claim 5, wherein each of the at least one calibration matrix relates a system sensor vector comprising the non-linear functions of the sensor color point coordinates to a color vector comprising the absolute color point coordinates.

9. The method according to claim 8, wherein the non-linear functions of the sensor color point coordinates comprise second order terms of said sensor color point coordinates.

10. The method according to claim 8, wherein the system sensor vector further comprises a constant term compensating for dark current effects.

11. The method according to claim 10, wherein the relationship defined by each of the at least one calibration matrix A corresponds to:

$$\begin{bmatrix} X \\ Y \\ Z \end{bmatrix} = A \begin{bmatrix} R \\ G \\ B \\ 1 \\ R^2 \\ G^2 \\ B^2 \end{bmatrix}$$

where R, G and B are the sensor color point coordinates and X, Y and Z are the absolute color point coordinates.

12. The method according to claim 5, wherein the at least one calibration matrix consists of a single calibration matrix associated with an average operation temperature of the LED lighting system.

13. The method according to claim 5, wherein the at least one calibration matrix consists of a plurality of calibration matrices each associated with a different operation temperature of the LED lighting system.

14. The method according to claim 1, wherein the at least one calibration matrix comprises a plurality of emitter calibration matrices each associated with an individual one of the LED emitters.

15. The method according to claim 14, wherein each emitter calibration matrix defines a relationship between an emitter sensor vector comprising the sensor color point coordinates for the associated individual one of the LED emitters and an emitter color vector comprising the absolute color point coordinates for said associated individual one of the LED emitters.

16. The method according to claim 15, wherein the relationship defined by the plurality of calibration matrices corresponds to:

$$\begin{bmatrix} X_k \\ Y_k \\ Z_k \end{bmatrix} = A_k \begin{bmatrix} R_k \\ G_k \\ B_k \end{bmatrix}$$

where k is an index representing one of the LED emitters, $A_k$ is the emitter calibration matrix associated with the LED emitter represented by said index k, $R_k$, $G_k$ and $B_k$ are the sensor color point coordinates of light emitted from the LED emitter represented by said index k, and $X_k$, $Y_k$ and $Z_k$ are the absolute color point coordinates of the light emitted from the LED emitter represented by said index k.

17. The method according to claim 15, wherein each emitter sensor vector further comprises a constant term compensating for dark current effects.

18. The method according to claim 15, wherein each emitter calibration matrix relates non-linear functions of the sensor color point coordinates to the absolute color point coordinates for the associated individual one of the LED emitters.

19. The method according to claim 14, wherein the determining of the absolute color point coordinates of the light output of step d) comprises:

i. estimating or measuring the sensor color point coordinates of light emitted from each of the LED emitters based on the sensor color point coordinates measured at step c);

ii. calculating the absolute color point coordinates of the light emitted from each of the LED emitters based on the sensor color point coordinates of the light emitted from the corresponding LED emitter and on the corresponding emitter calibration matrix;

iii. calculating the absolute color point coordinates of the light output as the sum of the absolute color point coordinates of the light emitted from each of said LED emitters.

20. The method according to claim 14, wherein the plurality of emitter calibration matrices comprises a single emitter calibration matrix for each LED emitter associated with an average operation temperature of the LED lighting system.

21. The method according to claim 14, wherein the plurality of emitter calibration matrices comprises a plurality of emitter calibration matrices for each LED emitter, each emitter calibration matrix being associated with a different operation temperature of the LED lighting system.

22. The method according to claim 1, wherein the LED emitters form three groups of same colored emitters, and step b) comprises determining said emitter drive settings solely based on the calibration data.

23. The method according to claim 1, wherein the LED emitters form more than three groups of same colored emitters, and step b) comprises calculating said emitter drive settings further based on at least one color rendering parameter related to a color rendering metric.

24. The method according to claim 1, wherein the steps c) to e) are repeated for a number of iterations for which the corresponding emitter drive settings are based on a different selected color, each selected color being geometrically opposite to the selected color of the previous iteration on a predetermined color space.

25. A LED lighting system for operation at a target output color, comprising:

three or more LED emitters emitting light of different colors combined into a light output;

a LED driver electrically connected to each LED emitter, each LED driver being configured to apply a controllable emitter drive setting to the corresponding LED emitter;

a color sensor positioned for measuring a portion of said light output;

a memory, containing calibration data obtained from measuring the light output of said LED lighting system for a plurality of values of the emitter drive settings, the memory further containing at least one calibration matrix defining a relationship between measurements from the color sensor of the LED lighting system represented by sensor color point coordinates and absolute color point coordinates in an absolute color space;

a controller configured to:

a) control the LED drivers to operate the LED emitters at emitter drive settings selected in view of the target output color;

b) measure the sensor color point coordinates of the light output using the color sensor;

c) determine the absolute color point coordinates of the light output based on the sensor color point coordinates measured at step b) and on the at least one calibration matrix; and d) compare the absolute color point coordinates determined at step c) to target color point coordinates representing said target color to determine if a predetermined matching condition is met, and, if not, repeat steps b) to d) using different operation drive settings.

26. The LED lighting system according to claim 25, wherein the values for the light output of the LED lighting system provided in the calibration data comprise measurements of said light output using a spectrometer for each of the plurality of values of the emitter drive settings.

27. The LED lighting system according to claim 25, wherein the values for the light output of the LED lighting system provided in the calibration data comprise measurements of said light output using a calibrated colorimeter for each of the plurality of values of the emitter drive settings.

28. The LED lighting system according to claim 25, having a same optical configuration during operation as during a calibration process having provided the at least one calibration matrix.

29. The LED lighting system according to claim 25, wherein each of the at least one calibration matrix relates non-linear functions of the sensor color point coordinates to the absolute color point coordinates.

30. The LED lighting system according to claim 29, wherein each of the at least one calibration matrix relates a system sensor vector comprising the non-linear functions of the sensor color point coordinates to a color vector comprising the absolute color point coordinates.

31. The LED lighting system according to claim 30, wherein the non-linear functions of the sensor color point coordinates comprise second order terms of said sensor color point coordinates.

32. The LED lighting system according to claim 25, wherein the at least one calibration matrix comprises a plurality of emitter calibration matrices, each associated with an individual one of the LED emitters.

33. The LED lighting system according to claim 32, wherein each emitter calibration matrix defines a relationship between an emitter sensor vector comprising the sensor color point coordinates for the associated individual one of the LED emitters and an emitter color vector comprising the absolute color point coordinates for said associated individual one of the LED emitters.

34. The LED lighting system according to claim 25, wherein the controller is operable to repeat steps b) to d) for a number of iterations for which the corresponding emitter drive settings are based on a different selected color, each selected color being geometrically opposite to the selected color of the previous iteration in a predetermined color space.

* * * * *